US009541852B2

(12) United States Patent
Fukudome et al.

(10) Patent No.: US 9,541,852 B2
(45) Date of Patent: Jan. 10, 2017

(54) TONER AND TWO-COMPONENT DEVELOPER

(71) Applicant: CANON KABUSHIKI KAISHA, Tokyo (JP)

(72) Inventors: Kosuke Fukudome, Tokyo (JP); Shuhei Moribe, Mishima (JP); Satoshi Mita, Fukuyama (JP); Kunihiko Nakamura, Gotemba (JP); Noriyoshi Umeda, Suntou-gun (JP); Yoshiaki Shiotari, Mishima (JP); Naoki Okamoto, Mishima (JP); Tetsuya Ida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 14/574,771

(22) Filed: Dec. 18, 2014

(65) Prior Publication Data

US 2015/0177635 A1 Jun. 25, 2015

(30) Foreign Application Priority Data

Dec. 20, 2013 (JP) ..... 2013-264246

(51) Int. Cl.

| | |
|---|---|
| ***G03G 9/00*** | (2006.01) |
| ***G03G 9/107*** | (2006.01) |
| ***G03G 9/08*** | (2006.01) |
| ***G03G 9/087*** | (2006.01) |

(52) U.S. Cl.

CPC ..... *G03G 9/107* (2013.01); *G03G 9/081* (2013.01); *G03G 9/08728* (2013.01); *G03G 9/08755* (2013.01); *G03G 9/08788* (2013.01); *G03G 9/08797* (2013.01)

(58) Field of Classification Search

CPC G03G 9/107; G03G 9/08728; G03G 9/08797; G03G 9/08755; G03G 9/081; G03G 9/08788

USPC ..... 430/109.1, 109.4

See application file for complete search history.

(56) References Cited

U.S. PATENT DOCUMENTS

| | | | | |
|---|---|---|---|---|
| 2007/0166636 | A1* | 7/2007 | Daimon | G03G 9/0825 430/109.3 |
| 2011/0065039 | A1* | 3/2011 | Ota | G03G 9/0821 430/109.3 |

FOREIGN PATENT DOCUMENTS

| | | | |
|---|---|---|---|
| JP | 2000-075549 | A | 3/2000 |
| JP | 2008-020848 | A | 1/2008 |
| JP | 2013-024920 | A | 2/2013 |

* cited by examiner

*Primary Examiner* — Thorl Chea

(74) *Attorney, Agent, or Firm* — Canon U.S.A. Inc., IP Division

(57) ABSTRACT

A toner contains toner particles. The toner particles are made of a resin containing an amorphous polyester resin, a releasing agent, an additive and a coloring agent. The additive has a polyester portion and a crystalline acrylic portion that are chemically bound to each other.

6 Claims, No Drawings

TONER AND TWO-COMPONENT DEVELOPER

BACKGROUND OF THE INVENTION

Field of the Invention

The present application relates to a toner and a two-component developer that are used in electrophotography, image forming methods for visualizing electrostatic latent images, and toner jet.

Description of the Related Art

Japanese Patent Laid-Open No. 2000-75549 discloses that a graft copolymer of a polyolefin resin and a vinyl resin is added as an additive to a toner containing a polyester resin as a binding resin in order to improve the hot offset resistance of the toner. This technique enhances the dispersibility of the releasing agent, thereby improving the hot offset resistance of the toner. This technique has not, however, been examined under severe conditions as in the case of printing on both sides of thin paper having a basis weight of less than 70 g/m$^2$. In order to reduce the occurrence of hot offset under such a condition, further improvement is desired.

Graft copolymers as used in the cited patent document can increase the dispersibility of the releasing agent, but tend to be compatible with the releasing agent. If the graft copolymer and the releasing agent are compatible with each other, they are plasticized to soften. This can degrade the durability of the toner in high-temperature environments.

Japanese Patent Laid-Open No. 2008-20848 discloses a toner containing a hybrid resin as a binding resin. The hybrid resin is produced by binding a polyester resin to a styrene-acrylic resin synthesized using an acrylic ester having a carbon number of 12 to 18 as a raw material monomer. This technique improves low-temperature fixability to some extent. In view of the fixability of the toner to thick paper having a basis weight of 100 g/m$^2$ or more, however, further improvement is desired.

In addition, the acrylic ester unit, which has a low glass transition temperature (Tg), of the styrene-acrylic resin synthesized using an acrylic resin having a carbon number of 12 to 18 induces an external additive to be embedded in high-temperature environments, so that the durability of the toner is often unsatisfactory.

Japanese Patent Laid-Open No. 2013-24920 discloses an emulsion polymerized toner containing a block copolymer as a binding resin, produced by binding a styrene-based polymer block and a crystalline acrylate-based polymer block to a polyester skeleton. This block copolymer, which is a ternary block copolymer in which the polyester skeleton binds to the styrene-based copolymer block binding to the crystalline acrylate-based copolymer block improves the fixability and charging stability of the toner.

In a toner using such a binding resin, however, the dispersion of the releasing agent is liable to be insufficient. The fixability and hot offset resistance of such a toner are also desired to be improved. In addition, the styrene-based polymer block in the toner is compatible with the releasing agent. This makes the crystalline acrylate-based polymer block compatible with the releasing agent. Accordingly, the toner is unlikely to exhibit satisfactory durability if it is used in high-temperature environments.

As described above, there has been no development of a toner which can exhibit a high hot offset resistance even in the case of printing on both sides of thin paper, and also exhibit high durability in high-temperature environments, despite of demand for such a toner.

SUMMARY OF THE INVENTION

The present invention provides a toner with a high fixability that exhibits a high hot offset resistance even in the case of printing on both sides of thin paper, and has high durability in high-temperature environments.

The present inventors have conducted intensive research on a toner that can exhibit a high hot offset resistance even in the case of printing on both sides of thin paper, and also exhibits a high durability in high-temperature environments.

Then, the inventors have found that a toner containing a polyester resin as a binding resin should be such that the releasing agent is sufficiently dispersed in the toner and that plasticization resulting from the compatibility of the releasing agent with any other constituent does not occur. In order to achieve a toner having such characteristics, it can be effective that a binding resin or additive having a site compatible with the releasing agent (releasing agent-compatible site) is added to the toner. The toner however becomes easy to plasticize as the dispersibility of the releasing agent is enhanced. It is thus difficult to satisfy both characteristics: high dispersibility of the releasing agent; and suppression of plasticization. Through many studies, the present inventors found that the use of an additive having a specific, crystalline, releasing agent-compatible site chemically bound to a site compatible with the binding resin (binding resin-compatible site) leads to a toner exhibiting both the two characteristics: high dispersibility of the releasing agent; and suppression of plasticization.

According to an aspect of the present application, there is provided a toner containing toner particles made of a resin containing an amorphous polyester resin, a releasing agent, an additive, and a coloring agent, wherein the additive comprises a polyester portion and a crystalline acrylic portion chemically bound to the polyester portion, and the crystalline acrylic portion has a partial structure expressed by the following chemical formula:

(1)

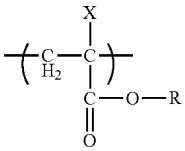

(R represents a hydrocarbon group having a carbon number of 18 to 30, and X represents hydrogen or a methyl group.)

The present application also provides a two-component developer containing the toner and a magnetic carrier.

Further features of the present invention will become apparent from the following description of exemplary embodiments.

DESCRIPTION OF THE EMBODIMENTS

The toner according to an embodiment of the present application contains toner particles. The toner particles contain an amorphous polyester resin A, a releasing agent B, an additive C, and a coloring agent.

The toner particles of the present embodiment have particle sizes the same as those of general toners. More specifically, the particle size of the toner particles is about 4.00 μm to 10.00 μm in terms of weight-average particle size (D4).

Additive C

The additive C is a resin having a polyester portion (C1) and a crystalline acrylic portion (C2) chemically bound to the polyester portion (C1). The polyester portion (C1) is a resin-compatible site compatible with the amorphous polyester resin A, and the crystalline acrylic portion (C2) is a releasing agent-compatible site compatible with the releasing agent B. The presence of the additive having the two compatible sites in the toner allows the releasing agent B to disperse uniformly in the toner. Consequently, the occurrence of hot offset can be satisfactorily prevented even in the case of printing on both sides of a thin paper.

It is important for the additive C that the crystalline acrylic portion (C2) as the releasing agent-compatible site has crystallinity. This feature prevents the additive C from being well mixed with the releasing agent and helps the releasing agent disperse uniformly. Since the additive C is not compatible with the releasing agent, the additive C and the releasing agent B are not plasticized, even in high-temperature environments, and consequently, a highly durable toner is produced.

The phrase "chemically bound to" used for the additive C means that the polyester portion (C1) and the crystalline acrylic portion (C2) are directly bound to each other. The phrase "directly bound to" means that the polyester portion (C1) and the crystalline acrylic portion (C2) are bound to each other without a linkage having a high molecular weight therebetween. In order to be "directly bound", the terminal unit of a polyester before being bound to the crystalline acrylic portion is changed into a unit that can react with the acrylic portion, and the unit is allowed to react with a monomer of a crystalline acrylic resin or a crystalline acrylic resin having a reactive group. The monomer used for introducing the unit capable of reacting with the crystalline acrylic portion to the terminal unit of the polyester before being bound to the crystalline acrylic portion may be a "bireactive monomer". The bireactive monomer will be described later. In such a structure of the additive C, the crystalline acrylic portion (C2) has high crystallinity, and accordingly plasticization resulting from the compatibility with the releasing agent can be suppressed. Consequently, the durability of the toner in high-temperature environments is increased. The reason for the increase of crystallinity is probably that the structure of the crystalline acrylic portion (C2) directly bound to the polyester portion (C1) having a large difference in polarity induces the self-alignment of the molecular chains of the crystalline acrylic portion (C2) and thus promotes crystallization.

If the additive has a structure in which the polyester portion (C1) and the crystalline acrylic portion (C2) are indirectly bound to each other with, for example, a unit derived from a styrene-based monomer therebetween, the compatibility of the additive with the releasing agent is unlikely to be reduced. This is probably because the releasing agent is well mixed with the unit derived from the styrene-based monomer in the manufacturing process and thus reduces the crystallization of the crystalline acrylic portion (C2). In this instance, the toner is expected to exhibit unsatisfactory durability in high-temperature environments because the additive and the releasing agent B will be plasticized.

If an attempt is made to suppress the plasticization of the additive C and the releasing agent B, it becomes difficult to enhance the dispersibility of the releasing agent. This results in insufficient hot offset resistance of the toner and is therefore disadvantageous.

If an additive having a polyester portion (C1) and an additive having a crystalline acrylic portion (C2) are used in combination, the dispersibility of the releasing agent is reduced, and accordingly the hot offset resistance of the toner is undesirably degraded in the case of printing on both sides of thin paper.

The additive C may be a block and/or a graft copolymer containing a block of polyester portions (C1) and a block of crystalline acrylic portions (C2).

The additive C may have another crystalline acrylic portion (C2) not bound to the polyester portion (C1), or another polyester portion (C1) not bound to the crystalline acrylic portion (C2).

The crystalline acrylic portion (C2) of the additive C has a partial structure expressed by formula (1), derived from an acrylic ester or a methacrylic ester.

(1)

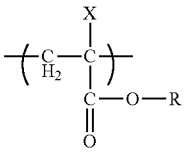

(R represents a hydrocarbon group having a carbon number of 18 to 30, and X represents hydrogen or a methyl group.)

The partial structure expressed by formula (1) of the crystalline acrylic portion (C2) advantageously allows the releasing agent to disperse uniformly and suppresses the releasing agent from plasticizing. If the hydrocarbon group R of the ester portion has a carbon number of less than 18, the crystalline acrylic portion (C2) does not have sufficient crystallinity. Consequently, the additive and the releasing agent become compatible and are mixed together, thereby being plasticized. Thus, the durability of the resulting toner becomes undesirably poor in high-temperature environments. On the other hand, if the hydrocarbon group R of the ester portion has a carbon number of more than 30, the cohesive attraction of the crystalline acrylic portion is excessively increased. Consequently, the additive does not allow the releasing agent to disperse uniformly, and consequently, the hot offset resistance of the toner is undesirably reduced in the case of printing on both sides of thin paper.

From the viewpoint of good balance between the durability of the toner and the hot offset resistance thereof, the carbon number of the hydrocarbon group R in formula (1) is preferably 20 to 26, and most preferably 22.

As the crystallinity of the additive increases, the additive can suppress the plasticization of the releasing agent more effectively, and accordingly the resulting toner can exhibit higher durability in high-temperature environments. It is therefore advantageous that the ester portion of the crystalline acrylic portion (C2) have a structure that can easily be arranged on a regular basis, and that the hydrocarbon group R in formula (1) is a linear alkyl.

From the viewpoint of increasing the crystallinity of the additive C as well, a structural unit derived from only one of acrylic and methacrylic esters may account for 95% by mole or more of all the structural units of the crystalline acrylic portion (C2). Preferably, it accounts for 99% by mole or more, more preferably 100% by mole.

The raw material monomer of the crystalline acrylic portion (C2) may be advantageously selected from, but not limited to, the monomers below.

Acrylic ester monomers include n-stearyl acrylate (carbon number of stearyl group: 18), n-arachidyl acrylate (carbon number of arachidyl group: 20), n-behenyl acrylate (carbon number of behenyl group: 22), n-hexacosyl acrylate (carbon number of hexacosyl group: 26), and n-triacontyl acrylate (carbon number of triacontyl group: 30). Methacrylic ester monomers include n-stearyl methacrylate (carbon number of stearyl group: 18), n-arachidyl methacrylate (carbon number of arachidyl group: 20), n-behenyl methacrylate (carbon number of behenyl group: 22), n-hexacosyl methacrylate (carbon number of hexacosyl group: 26), and n-triacontyl methacrylate (carbon number of triacontyl group: 30).

The crystalline acrylic portion (C2) may have other partial structures derived from monomers other than the above-cited monomers, in addition to the partial structure expressed by chemical formula (1). The "other monomers" include vinyl monomers such as the following styrene-based monomers and acrylic acid-based monomers. These monomers may be used singly or in combination.

Exemplary styrene-base monomers include styrene and o-methylstyrene. Exemplary acrylic acid-based monomers include acrylic acid, methacrylic acid, and derivatives derived from the esters thereof.

An example of the acrylic ester-based derivatives may be formed by substituting an alkyl or alkenyl group having a carbon number of 1 to 50 for the hydrogen of the carboxy group of acrylic acid. More specifically, such acrylic ester-based derivatives include methyl acrylate, n-butyl acrylate, 2-ethylhexyl acrylate, n-lauryl acrylate, cyclohexyl acrylate, and t-butyl acrylate. An example of the methacrylic ester-based derivatives may be formed by substituting a linear alkyl and/or a cyclic alkyl or alkenyl group having a carbon number of 1 to 50 for the hydrogen of the carboxy group of methacrylic acid. More specifically, such methacrylic ester-based derivatives include methyl methacrylate, n-butyl methacrylate, 2-ethylhexyl methacrylate, n-lauryl methacrylate, cyclohexyl methacrylate, and t-butyl methacrylate.

If partial structures derived from these "other monomers" account for a large part of the crystalline acrylic portion (C2), however, the crystallinity of the additive C is degraded. This can cause the releasing agent B and the additive C to be mixed to or dissolved in each other. It is therefore advantageous from the viewpoint of increasing the durability of the toner in high-temperature environments that the proportion of the amount of "other monomers" to the total amount of the raw material monomers forming the crystalline acrylic portion (C2) be less than 5% by mole, and more advantageously less than 1% by mole.

The crystalline acrylic portion (C2) may be a unit formed using a polymerization initiator. The polymerization initiator may be selected from known initiators including azo polymerization initiators and organic peroxide-based polymerization initiators. Azo polymerization initiators include 2,2'-azobisisobutyronitrile, 2,2'-azobis(4-methoxy-2,4-dimethylvaleronitrile), and 2,2'-azobis(2,4-dimethylvaleronitrile).

For organic peroxide-based polymerization initiators, the organic peroxide has a skeleton containing a carbon atom. Examples of such an organic peroxide-based polymerization initiator include di(2-butylperoxyisopropyl)benzene, dicumyl peroxide, di-t-hexyl peroxide, 2,5-dimethyl-2,5-di(t-butylperoxy)hexane, 1,3-bis-(t-butylperoxyisopropyl)benzene, t-butylcumyl peroxide, di-t-butyl peroxide, p-menthane hydroperoxide, 2,5-dimethyl-2,5-di(t-butylperoxy)hexyne-3, di-t-amyl peroxide, and 1,1,3,3-tetramethylbutyl hydroperoxide. These initiators may be used singly or in combination.

The amount of the polymerization initiator to be used is preferably in the range of 0.01 to 20 parts by mass, such as in the range of 0.05 to 10 parts by mass, relative to the total mass (100 parts by mass) of the raw material monomers of the crystalline acrylic portion (C2) from the viewpoint of polymerization efficiency.

The additive C has a crystallinity deriving from the crystalline acrylic portion (C2). This crystallinity can be confirmed by the presence of a melting peak on a temperature-endothermic curve prepared by differential scanning calorimetry (DSC) of the additive C. In the present embodiment, when the additive C exhibits an endothermic peak of 1.00 J/g or more, the peak is defined as the "melting peak". The presence of such a melting peak confirms that the additive C has a crystallinity.

In addition, the peak temperature Tmc of the melting peak of the additive C lies desirably in the range of 50° C. to 70° C. When the peak temperature Tmc is 50° C. or more, the crystalline acrylic portion (C2) is likely to maintain the crystallinity thereof even if the toner is exposed to a high-temperature environment, thus helping provide a more durable toner. Also, when the peak temperature Tmc is 70° C. or less, the toner can exhibit high hot offset resistance. This is probably because the crystalline acrylic portion (C2) in the toner is rapidly melted by heat from a fuser and thus helps the releasing agent near the crystalline acrylic portion (C2) seep out of the surface of the toner.

The heat of melting ΔHc per gram of the additive C at the melting peak is preferably in the range of 2.00 J/g to 20.00 J/g, more preferably in the range of 5.00 J/g to 15.00 J/g when measured by differential scanning calorimetry (DSC). The heat of melting ΔHc corresponds to the amount of crystals in the additive C. When ΔHc is 2.00 J/g or more, the additive C contains many crystal structures and is likely to maintain the crystal structures without being well mixed with the releasing agent. Consequently, the durability of the toner in high-temperature environments is further increased. Also, when ΔHc is 20.00 J/g or less, the crystals of the crystalline acrylic portion (C2) melt rapidly to help the releasing agent seep out of the surface of the toner when the toner is fixed. Thus the hot offset resistance is further increased advantageously.

The half-width Wc of the melting peak of the additive C may be 5.00° C. or less. When the additive exhibits such a melting peak, the durability of the toner is further increased in high-temperature environments. A narrower half-width Wc implies that the crystal structure of the additive C is not disturbed much, and the additive C having such a crystal structure is more incompatible with the releasing agent. Thus the plasticization of the additive and the releasing agent is further suppressed.

In order to control the Tmc, ΔHc and Wc values of the additive C in the above-mentioned ranges, the proportions of the raw material monomers of the crystalline acrylic portion (C2), the carbon number of the ester portion of the raw material monomer, and the content of the crystalline acrylic portion (C2) in the additive C are appropriately adjusted.

The content of the crystalline acrylic portion (C2) in the additive may be in the range of 5% to 25% by mass relative to the total mass of the additive C. The crystalline acrylic portion (C2) with a content of 5% by mass or more allows the releasing agent to disperse uniformly and tends to maintain the crystal structure of the additive C in the toner, thus being advantageous for providing a toner having high durability and hot offset resistance. Also, the crystalline acrylic portion (C2) with a content of 25% by mass or less allows the releasing agent in the toner to seep out efficiently without being trapped as a result of the association with the crystalline acrylic portion (C2) when the toner is fixed. Thus the hot offset resistance of the toner and gloss uniformity are advantageously improved.

The weight average molecular weight Mwc2 of the crystalline acrylic portion (C2) is not particularly limited, but may be in the range of 5,000 to 34,000 from the viewpoint of achieving a toner having both higher durability and higher hot offset resistance. When the Mwc2 is 5,000 or more, the crystallinity of the crystalline acrylic portion (C2) is increased to reduce the compatibility with the releasing agent, consequently providing a durable toner. Also, when the Mwc2 is 34,000 or less, the crystalline acrylic portion (C2) is finely dispersed in the toner to help the releasing agent disperse uniformly, consequently providing a toner having high hot offset resistance. The calculation of Mwc2 will be described later.

The polyester portion (C1) of the additive C is formed by polycondensation of an alcohol component and an acid component and is not otherwise limited. Advantageous forms of the polyester portion (C1) will be described below.

Raw material monomers suitable for the polyester portion (C1) will first be described.

Divalent alcohol components can be used as a raw material monomer. Exemplary dihydric alcohol components include aromatic alcohols represented by bisphenol A alkylene oxide adducts expressed by the following chemical formula (2), including polyoxypropylene adducts of 2,2-bis(4-hydroxyphenyl)propane and polyoxyethylene adducts of 2,2-bis(4-hydroxyphenyl)propane; and aliphatic alcohols, such as ethylene glycol, 1,3-propylene glycol, and neopentyl glycol.

(2)

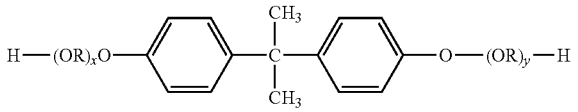

(R represents an alkylene group having a carbon number of 2 or 3, and x and y each represent an integer of 0 or more, and the sum of x and y is in the range of 1 to 16, preferably 2 to 5.)

Trivalent or higher alcohol components may also be used. Exemplary trihydric or more alcohol components include sorbitol, pentaerythritol, and dipentaerythritol. These dihydric and trihydric or more alcohol components may be used singly or in combination.

Divalent carboxylic acid components can be used as the acid component. Exemplary divalent carboxylic acid components include maleic acid, fumaric acid, phthalic acid, isophthalic acid, terephthalic acid, succinic acid, adipic acid, sebacic acid, dodecanedioic acid and n-dodecenylsuccinic acid, and anhydrides or lower alkyl esters thereof. Trivalent or higher carboxylic acids may also be used, such as 1,2,4-benzene tricarboxylic acid, 2,5,7-naphthalene tricarboxylic acid, pyromellitic acid and Empol trimer acid, and acid anhydrides or lower alkyl esters thereof.

The polyester portion (C1) may be formed by esterification or transesterification using any of the above-cited monomers without particular limitation.

For polymerizing the raw material monomer, a generally used esterification catalyst, such as dibutyltin oxide, may be appropriately added to accelerate the reaction.

The weight average molecular weight Mwc1 of the polyester portion (C1) is not particularly limited, but may be in the range of 3,000 to 100,000 from the viewpoint of achieving a toner having good balance between durability and hot offset resistance. When the Mwc1 is 3,000 or more, the hardness of the polyester portion (C1) is increased to increase the durability of the toner. Also, when the Mwc1 is 100,000 or less, the affinity of the polyester portion (C1) to the amorphous polyester resin A is increased to help the releasing agent disperse more uniformly in the toner. Thus the toner exhibits high hot offset resistance.

The weight average molecular weight Mwc of the additive C is not particularly limited, but may be in the range of 4,000 to 200,000 from the viewpoint of achieving a toner having good balance between durability and hot offset resistance. When the Mwc is 4,000 or more, the hardness of the additive C is increased to increase the durability of the toner. Also, when the Mwc is 200,000 or less, the additive C is easy to disperse uniformly in the toner and thus helps the releasing agent disperse. Consequently, the resulting toner can exhibit high hot offset resistance.

As described above, the additive C is a resin having the polyester portion (C1) and the crystalline acrylic portion (C2) that are chemically bound to each other via a unit derived from the bireactive monomer of the polyester portion (C1). The bireactive monomer mentioned herein refers to a compound capable of reacting with both polycondensation monomers and addition polymerization monomers. Examples of such a bireactive monomer include fumaric acid, maleic acid, acrylic acid, methacrylic acid, citraconic acid, anhydrides such as maleic anhydride, and methylated compounds such as dimethyl fumarate. Among these, maleic anhydride is particularly advantageous, which enables the additive C to further increase the dispersibility of the releasing agent and allows the releasing agent to seep out when the toner is fixed.

The bireactive monomer may be added during polycondensation of the polyester portion (C1), added together with other polycondensation monomers, or added after polymerizing other polycondensation monomers into a polyester intermediate. From the viewpoint of increasing the dispersibility of the releasing agent in the additive C and helping the releasing agent seep out, it is advantageous that maleic anhydride be added after forming a polyester intermediate.

This is probably because the additive C becomes a resin having a structure bound to the crystalline acrylic portion (C2) at the terminal of the polyester portion (C1), so that a steric hindrance to the crystalline acrylic portion (C2) is reduced. By reducing the steric hindrance, the probability of the crystalline acrylic portion (C2) having contact with the releasing agent is increased, and thus the dispersibility of the releasing agent is enhanced. Consequently, the releasing agent can rapidly seep out of the toner when the toner is fixed.

Preferably, the amount of the bireactive monomer used may be in the range of 0.1% to 20.0% by mass, such as 0.2% to 10.0% by mass, relative to the total mass of the monomers used for synthesizing the polyester portion (C1).

The content of the additive C may be in the range of 2.0 parts by mass to 20.0 parts by mass relative to the total mass (100.0 parts by mass) of the binding resins (amorphous polyester resin A, additive C, and polycrystalline polyester resin D). Desirably, it is in the range of 2.0 parts by mass to 18.0 parts by mass. When the content of the additive C is in such a range, the dispersion of the releasing agent B in the toner can be more easily controlled.

Production Process of Additive C

The additive C may be produced by any process without particular limitation. Exemplary processes will be described below.

Exemplary processes for producing the additive C include the following (1) to (4), and process (1) may be more advantageous because it facilitates the formation of a stable chemical binding between the polyester portion (C1) and the crystalline acrylic portion (C2) and thus reduces unreacted residues.

(1) Process of producing the additive C by polymerizing raw material monomers of the polyester portion (C1) other than the bireactive monomer, then binding the bireactive monomer to form the polyester portion (C1), and finally adding the raw material monomer of the crystalline acrylic portion (C2) to polymerize.

(2) Process of producing the additive C by polymerizing the raw material monomer of the polycrystalline acrylic portion (C2), then adding the bireactive monomer to be bound to the crystalline acrylic portion (C2), and finally adding raw material monomers of the polyester portion (C1) other than the bireactive monomer to polymerize.

(3) Process of producing the additive C by polymerizing the crystalline acrylic portion (C2) and the polyester portion (C1) separately, and binding the polyester portion (C1), the crystalline acrylic portion (C2) and the bireactive monomer.

(4) Process of producing the additive C by polymerizing the raw material monomer of the polyester portion (C1) and the bireactive monomer to form the polyester portion (C1), and then adding the raw material monomer of the crystalline acrylic portion (C2) to polymerize.

A more advantageous process (1) will now be further described in detail.

A raw material monomer for forming the polyester portion (C1) and an esterification catalyst are mixed in a polymerization kettle equipped with a pressure-reducing device, a water separator, a nitrogen gas-delivering device, a temperature measuring device and a stirrer. Then, the mixture is subjected to reaction in a nitrogen atmosphere under normal pressure for 2 to 30 hours, preferably 4 to 20 hours, with the temperature in the kettle controlled in the range of 150° C. to 300° C., preferably 160° C. to 250° C. Then, the kettle is evacuated for dehydration and condensation for 1 to 10 hours, preferably 2 to 5 hours, to yield a polyester intermediate.

After the pressure in the kettle is returned to normal atmospheric pressure, a bireactive monomer is added to the melted polyester intermediate with the temperature in the kettle controlled in the range of 130° C. to 220° C., preferably 140° C. to 200° C., thereby binding each other to form the polyester portion (C1).

Then, the raw material monomer of the crystalline acrylic portion (C2) is added to the melted polyester portion (C1) with the temperature in the kettle controlled in the range of 130° C. to 200° C., and sufficiently mixed to be dissolved. To this mixture, a polymerization initiator is added at one time or in portions several times, and thus addition polymerization is performed for 1 to 10 hours. Then, the unreacted low-molecular-weight residue is removed by vacuum distillation for 1 to 10 hours with the temperature in the kettle held, and the reaction product is removed to yield the additive C.

Amorphous Polyester Resin A

The amorphous polyester resin A is produced by polycondensation of an alcohol component and an acid component and is not otherwise limited. Advantageous forms of the amorphous polyester resin A will be described below.

Raw material monomers suitable for the amorphous polyester resin A will first be described.

Divalent alcohol components can be used as a raw material monomer. Exemplary dihydric alcohol components include aromatic alcohols represented by bisphenol A alkylene oxide adducts expressed by the foregoing chemical formula (2), including polyoxypropylene adducts of 2,2-bis(4-hydroxyphenyl)propane and polyoxyethylene adducts of 2,2-bis(4-hydroxyphenyl)propane; and aliphatic alcohols, such as ethylene glycol, 1,3-propylene glycol, and neopentyl glycol.

Trivalent or higher alcohol components may also be used. Exemplary trihydric or more alcohol components include sorbitol, pentaerythritol, and dipentaerythritol. Divalent and trihydric or more alcohol components may be used singly or in combination.

Divalent carboxylic acid components can be used as the acid component. Exemplary divalent carboxylic acid components include maleic acid, fumaric acid, phthalic acid, isophthalic acid, terephthalic acid, succinic acid, adipic acid, sebacic acid, dodecanedioic acid and n-dodecenylsuccinic acid, anhydrides of these acids, and lower alkyl esters of these acids. Trivalent or more carboxylic acids may also be used, such as 1,2,4-benzene tricarboxylic acid, 2,5,7-naphthalene tricarboxylic acid, pyromellitic acid and Empol trimer acid, and acid anhydrides or lower alkyl esters thereof.

The amorphous polyester resin A may be produced by esterification or transesterification using raw material monomers as cited above without particular limitation. For polymerizing the raw material monomer, a commonly used esterification catalyst, such as dibutyltin oxide, may be appropriately added to accelerate the reaction.

The glass transition temperature (Tg) of the amorphous polyester resin A may be in the range of 45° C. to 75° C. from the viewpoint of the durability and fixability of the toner. In the same view point, the softening point of the amorphous polyester resin A may be in the range of 80° C. to 150° C.

The weight average molecular weight Mwa of the amorphous polyester resin A may be in the range of 8,000 to 1,200,000, such as 40,000 to 300,000, from the viewpoint of the durability and fixability of the toner.

The acid value of the amorphous polyester resin A may be in the range of 2 mg KOH/g to 40 mg KOH/g from the viewpoint of the durability of the toner and the uniformity of image gloss.

The amorphous polyester resin A may be composed of a single polyester resin, or may be a mixture of two or more polyester resins. From the viewpoint of providing a toner having higher fixability and higher hot offset resistance, it is advantageous to combine a plurality of amorphous polyester resins having different molecular weights and glass transition temperatures Tg.

The amorphous polyester resin A may be the main part of the binding resins, and the content thereof may be in the range of 60.0 parts by mass to 98.0 parts by mass relative to the total mass (100.0 parts by mass) of the binding resins (amorphous polyester resin A, additive C, and polycrystalline polyester resin D). Desirably, it is in the range of 67.0 parts by mass to 93.0 parts by mass. When the content of the amorphous polyester resin A is in such a range, the amorphous polyester resin A can act suitably as a dispersion medium of the additive C and the crystalline polyester resin D, allowing these constituents to disperse satisfactorily.

Crystalline Polyester Resin D

The toner of an embodiment may contain a crystalline polyester resin D. The presence of the crystalline polyester resin D helps the toner melt sharply when the toner is fixed. Thus the toner can exhibit good fixability to thick paper. This is because the crystalline polyester resin D becomes compatible with the amorphous polyester resin A and other binding resins in the toner when the toner is fixed, thereby plasticizing the toner. Known toners containing a crystalline polyester resin are liable to be plasticized even at room temperature and thus tend to have poor durability. On the other hand, in the toner of the present embodiment, the crystals of the crystalline acrylic portion (C2) and releasing agent B are well dispersed in the toner and act as crystal nuclei to increase the crystallinity of the crystalline polyester resin D. Thus, the plasticization of the toner can be suppressed at room temperature. The addition of the crystalline polyester resin D is advantageous for improving the fixability of the toner on thick paper while maintaining the durability of the toner.

The crystalline polyester resin D has a polyester molecular chain (D1) capable of developing the crystallinity thereof, and is not otherwise limited.

Raw material monomers that can be used for synthesizing the polyester molecular chain (D1) will now be described.

Alcohols that can be used as a raw material monomer of the polyester molecular chain (D1) include aliphatic diols having a carbon number in the range of 4 to 18. These are advantageous for increasing crystallinity. Among these, linear aliphatic diols having a carbon number in the range of 6 to 12 tend to increase the fixability and durability of the toner and are thus more advantageous. Aliphatic diols include 1,6-hexanediol, 1,7-heptanediol, 1,8-octanediol, 1,9-nonanediol, 1,10-decanediol, 1,11-undecanediol, and 1,12-dodecanediol. The aliphatic diol content may be in the range of 80.0% to 100.0% by mole relative to the total moles of the alcohol component from the viewpoint of increasing the crystallinity of the crystalline polyester resin D. Preferably, the aliphatic diol content is in the range of 90.0% to 100.0% by mole, more preferably, 95.0% to 100.0% by mole.

Polyhydric alcohols may further be used as the alcohol component used as the raw material monomer of the polyester molecular chain (D1), in addition to the aliphatic diol. Exemplary polyhydric alcohols include aromatic diols represented by bisphenol A alkylene oxide adducts expressed by the foregoing chemical formula (2), including polyoxypropylene adducts of 2,2-bis(4-hydroxyphenyl)propane and polyoxyethylene adducts of 2,2-bis(4-hydroxyphenyl)propane; and trihydric alcohols, such as glycerol, pentaerythritol, and trimethylol propane.

Carboxylic acid components that can be advantageously used as a raw material monomer of the polyester molecular chain (D1) include aliphatic dicarboxylic acid compounds having a carbon number in the range of 4 to 18. Among these, linear aliphatic dicarboxylic acid compounds having a carbon number in the range of 6 to 12 tend to increase the fixability and durability of the toner and are thus advantageous. Aliphatic dicarboxylic acid compounds include 1,8-octanedioic acid, 1,9-nonanedioic acid, 1,10-decanedioic acid, 1,11-undecanedioic acid, and 1,12-dodecanedioic acid.

The content of the aliphatic dicarboxylic acid compound having a carbon number of 6 to 18 may be in the range of 80.0% by mole to 100.0% by mole relative to the total moles of the carboxylic acid component from the viewpoint of increasing the crystallinity of the crystalline polyester resin D. Preferably, it is in the range of 90.0% by mole to 100.0% by mole, more preferably, 95% by mole to 100.0% by mole.

Other carboxylic acid components may further be added for forming the polyester molecular chain (D1) in addition to the aliphatic dicarboxylic acid. Such carboxylic acid components include, but are not limited to, aromatic dicarboxylic acid compounds and trivalent or more carboxylic acid compounds. The aromatic dicarboxylic acid compound may be an aromatic dicarboxylic acid derivative. Exemplary aromatic dicarboxylic acid compounds include aromatic dicarboxylic acids, such as phthalic acid, isophthalic acid, and terephthalic acid; anhydrides thereof; and alkyl (having a carbon number of 1 to 3) esters thereof. Examples of the alkyl group of the alkyl esters include methyl, ethyl, propyl, and isopropyl. Trivalent or more carboxylic acid compounds include aromatic carboxylic acids, such as 1,2,4-benzene tricarboxylic acid (trimellitic acid), 2,5,7-naphthalene tricarboxylic acid, and pyromellitic acid; anhydrides thereof; and alkyl (having a carbon number of 1 to 3) esters thereof.

The polyester molecular chain (D1) of the crystalline polyester resin D may be formed by polycondensation of a saturated aliphatic diol and a saturated aliphatic dicarboxylic acid from the viewpoint of further increasing the crystallinity thereof and thereby improving the durability of the toner.

For forming the polyester molecular chain (D1), the mole ratio of the carboxylic acid component of the raw material monomers to the alcohol component thereof (carboxylic component/alcohol component) may be in the range of 0.70 to 1.30.

From the viewpoint of producing a toner having further improved fixability and durability, the crystalline polyester resin D may have an alkyl portion (D2) derived from an aliphatic monohydric alcohol having a carbon number in the range of 12 to 30 or from an aliphatic monocarboxylic acid having a carbon number in the range of 13 to 31 at an end of the polyester molecular chain (D1). Desirably, the alkyl portion (D2) has a main chain including a linear hydrocarbon-based portion and is a portion deriving from a compound having a monovalent or more functional group capable of reacting with an end of the polyester molecule chain (D1).

The alkyl portion (D2) allows the polyester molecule chain (D1) to plasticize the amorphous polyester resin A and the polyester portion (C1) of the additive C, and also allows the alkyl portion (D2) to plasticize the crystalline acrylic portion (C2) of the additive C, when the toner is fixed. The synergism of such plasticizations further helps the toner melt sharply and thus further increases the fixability of the toner.

The reason why the durability of the toner is improved is probably as below. The alkyl portion (D2) not only acts as crystal nuclei of the crystalline polyester resin D to increase the crystallinity of the crystalline polyester resin D, but also acts as crystal nuclei of the crystalline acrylic portion (C2) of the additive C to increase the crystallinity of the crystalline acrylic portion (C2). The crystallinities of constituents in the toner are synergistically increased, so that the toner is prevented from being plasticized even in high-temperature environments and exhibits good durability.

The alkyl portion (D2) content in the crystalline polyester resin D may be in the range of 0.10% to 4.00% by mole, such as 0.50% to 7.00% by mole, from the viewpoint of fixability and durability of the toner.

It can be checked by the following analysis whether the polyester molecule chain (D1) and the alkyl portion (D2) are bound to each other in the crystalline polyester resin D.

A sample solution is prepared by adding 2 mL of chloroform to accurately weighed 2 mg of a sample of the crystalline polyester resin to dissolve the sample. Subsequently, a matrix solution is prepared by adding 1 mL of chloroform to accurately weighed 20 mg of 2,5-dihydroxybenzoic acid (DHBA) to dissolve the DHBA. Also, an ionizing agent solution is prepared by adding 1 mL of acetone to accurately weighed 3 mg of sodium trifluoroacetate (NaTFA) to dissolve the NaTFA.

The above prepared solutions: 25 μL of sample solution; 50 μL of matrix solution; 5 μL of ionizing agent solution are mixed, and the mixture is dropped onto a sample plate for matrix assisted laser desorption/ionization (MALDI) analysis and dried to yield a measuring sample. A MALDI-TOFMS analyzer Reflex III (manufactured by Bruker Daltonics) may be used to obtain the mass spectrum of the measuring sample. It is examined what each peak in the oligomer region (m/z: 2000 or less) in the mass spectrum derives from, and then it is checked whether or not there is a peak corresponding to the structure of the alkyl portion (D2) bound to an end of the polyester molecular chain (D1).

The weight average molecular weight Mwd of the crystalline polyester resin D may be in the range of 8,000 to 100,000, such as 12,000 to 45,000, from the viewpoint of the durability and fixability of the toner.

The acid value of the crystalline polyester resin D may be in the range of 1 mg KOH/g to 30 mg KOH/g from the viewpoint of the durability of the toner and the uniformity of image gloss.

The crystalline polyester resin D has a crystallinity, and, when heated, exhibits an endothermic peak of at least 1.00 J/g in differential scanning calorimetry (DSC).

The heat of melting (ΔH) calculated from the endothermic peak area may be, but is not limited to, in the range of 80 J/g to 160 J/g from the viewpoint of the fixability and durability of the toner. In the same view point, the melting point of the crystalline polyester resin D may be in the range of 60° C. to 120° C., such as 70° C. to 90° C.

The content of the crystalline polyester resin D in the toner may be in the range of 3.0 parts by mass to 20.0 parts by mass, such as 5 parts by mass to 15.0 parts by mass, relative to the total mass (100.0 parts by mass) of the binding resins (amorphous polyester resin A, additive C, and polycrystalline polyester resin D). When the content of the crystalline polyester resin D is 3 parts by mass or more, the binding resins become easy to plasticize uniformly when the toner is fixed. Consequently, the toner exhibits high fixability even on thick paper. Also, when the content of the crystalline polyester resin D is 20 parts by mass or less, the toner is prevented from plasticizing even in high-temperature environments, consequently exhibiting high durability.

The softening point of the toner may be in the range of 80° C. to 130° C. from the viewpoint of the fixability thereof. The weight average molecular weight Mw of the toner may be in the range of 3,000 to 120,000 from the viewpoint of the fixability and hot offset resistance thereof.

Releasing Agent B

Examples of the materials that can be advantageously used as the releasing agent B include low-molecular-weight polyethylenes, low-molecular-weight polypropylenes, microcrystalline waxes, and hydrocarbon waxes such as paraffin waxes. These are easy to disperse in the toner and releasable. The releasing agent B may further contain a small amount of one or more waxes, if necessary.

Examples of such a wax include VISCOL (registered trademark) series: 330-P, 550-P, 660-P, and TS-200 (manufactured by Sanyo Chemical Industries); HI-WAX series: 400P, 200P, 100P, 410P, 420P, 320P, 220P, 210P, and 110P (Mitsui Chemical); Sasol waxes: H1, H2, C80, C105, and C77 (produced by Schumann Sasol); HNP-1, HNP-3, HNP-9, HNP-10, HNP-11, and HNP-12 (each produced by Nippon Seiro); Uniline (registered trademark) series: 350, 425, 550 and 700, and Unicid (registered trademark) series: 350, 425, 550 and 700 (each produced by Toyo ADL); and other waxes, such as Japan waxes, beeswaxes, rice waxes, candelilla waxes, carnauba waxes (available from CERARICA NODA), and ester waxes (e.g. behenyl behenate).

The releasing agent B may be added by a known method in a melt-kneading step in the manufacture of the toner, or in the process of producing the amorphous polyester resin A. Alternatively, the releasing agent B may be used independently.

The proportion of the releasing agent B to be added may be in the range of 1.0 parts by mass to 20.0 parts by mass relative to the total mass (100.0 parts by mass) of the binding resins (amorphous polyester resin A, additive C, and polycrystalline polyester resin D).

The melting peak temperature Tmb of the releasing agent B observed by differential scanning calorimetry (DSC) may be in the range of 50° C. to 100° C., such as 60° C. to 80° C., from the viewpoint of the hot offset resistance and durability of the toner and the uniformity of image gloss.

Difference in melting peak temperature (Tmb−Tmc)

When the melting peak temperature Tmb of the releasing agent B and the melting peak temperature Tmc of the additive C, each measured by differential scanning calorimetry (DSC), are satisfy the inequality: $3 \leq Tmb - Tmc \leq 23$, the uniformity of image gloss is further increased.

In two-side printing, the amount of the releasing agent seeping out of the toner is varied depending on the difference between the amounts of heat that the front side and rear side of the printing medium receive. This can result in a difference in image gloss. The toner of the present embodiment satisfying the above inequality, however, can control the seepage of the releasing agent, thus uniforming the image glosses of the front side and rear side. The reason for this is probably as below.

The above inequality suggests that the difference in melting peak temperature between the releasing agent B and the additive C is relatively small, and that the melting peak temperature of the additive C is lower than that of the releasing agent B. When the above inequality holds true, the crystalline acrylic portion (C2) of the additive C melts first in the fixing nip, and then immediately the releasing agent B melts. At this time, probably, the melting of crystals of the crystalline acrylic portion (C2) rapidly increases molecular motion to help the releasing agent B melt, thus accelerating the seepage of the releasing agent through the surface of the toner. Consequently, the releasing agent can seep out stably independently of the amount of heat that the toner receives in the fixing nip and thus can form a uniform layer over the surface of the printed image. Accordingly, a uniform image gloss can be achieved even in two-side printing.

When the value of "Tmb−Tmc" is 3° C. or more, the melting of the crystals of the crystalline acrylic portion (C2) advantageously accelerates the melting of the releasing agent B. When the value of "Tmb−Tmc" is 23° C. or less, the melting of the releasing agent B does not delay. This makes it easy to accelerate the seepage of the releasing agent. More advantageously, "Tmb−Tmc" is in the range of 5° C. to 17° C.

The toner of the present embodiment may be a magnetic toner or a nonmagnetic toner. If the toner is magnetic, magnetic iron oxide may be added. The magnetic iron oxide may be magnetite, maghemite, ferrite, or the like. In order to satisfactorily disperse the magnetic iron oxide among the toner particles, the magnetic iron oxide may be sheared so as to temporarily disentangle the magnetic iron oxide.

If the toner is magnetic, the magnetic iron oxide content in the toner is in the range of 25% to 45% by mass, such as 30% to 45% by mass, relative to the total mass of the toner.

If the toner is non-magnetic, one or more of the carbon black and other known pigments and dyes can be used as the coloring agent. The coloring agent may be added in a proportion in the range of 0.1 part by mass to 60.0 parts by mass, such as 0.5 part by mass to 50.0 parts by mass, relative to the total mass (100.0 parts by mass) of the binding resins (amorphous polyester resin A, additive C, and polycrystalline polyester resin D).

Fluidity Improver

The toner of the present embodiment may further contain a fluidity improver, such as inorganic fine particles, so that the toner particles flow out easily. Any material can be used as the fluidity improver as long as it can enhance the fluidity of the toner particles by being externally added to the toner particles. Exampled of the fluidity improver include fluororesin powder such as vinylidene fluoride or polytetrafluoroethylene fine powder, and silica fine powder produced in a wet process or a dry process. The silica fine powder may be surface-treated with a silane coupling agent, a titanium coupling agent, a silicone oil, or the like. Silica fine powder, called dry-processed silica or fumed silica, produced by gas phase oxidation of a silicon halide is advantageously used as the fluidity improver. For example, this gas phase oxidation uses pyrolytic oxidation of silicon tetrachloride gas in oxygen and hydrogen, and is expressed by the following reaction formula:

$$SiCl_4+2H_2+O_2 \rightarrow SiO_2+4HCl$$

The fluidity improver may be a composite fine powder of a metal oxide and silica produced by using a metal halide such as aluminum chloride or titanium chloride together with a silicon halide.

More advantageously, the silica fine powder produced by gas phase oxidation of a silicon halide is subjected to hydrophobization treatment. Particularly advantageously, the thus treated silica fine power has a hydrophobicity, measured by methanol titration, in the range of 30 to 98.

The hydrophobization of the silica fine powder may be performed by chemical treatment with an organic silicon compound reactive with the silica fine powder, or an organic silicon compound capable of physically adsorbing the silica fine powder. A process is advantageous in which a silica fine powder produced by gas phase oxidation of a silicon halide is treated with an organic silicon compound. Examples of such an organic silicon compound include. hexamethyldisilazane, trimethyl silane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetra methyldisiloxane, and 1,3-diphenyltetramethyldisiloxane. These organic silicon compounds may be used singly or in combination.

The silica fine powder may be treated with silicone oil, and this treatment may be performed simultaneously with the above-described hydrophobization. The silicone oil may have a viscosity in the range of 30 $mm^2/s$ to 1000 $mm^2/s$ at 25° C. Advantageous examples of such a silicone oil include dimethyl silicone oil, methylphenyl silicone oil, α-methylstyrene-modified silicone oil, chlorophenyl silicone oil, and fluorine-modified silicone oil.

The treatment with silicone oil may be performed by: directly mixing the silica fine powder treated with a silane coupling agent and a silicone oil in a mixer such as a Henschel mixer; spraying a silicone oil on the base silica fine powder; or mixing the silica fine power by adding the powder into a solution or dispersion of a silicone oil in a solvent or medium, followed by removing the solvent or medium. The silicone oil-treated silica is desirably heated to a temperature of 200° C. or more (more desirably 250° C. or more) in an inert gas atmosphere to stabilize the coating over the surfaces of the silica powder particles.

The silane coupling agent may be hexamethyldisilazane (HMDS). In the preset embodiment, silica previously treated with a coupling agent may be treated with a silicone oil, or a silica may be simultaneously treated with a coupling agent and a silicone oil.

The inorganic powder may be added in a proportion in the range of 0.01 part by mass to 8.00 parts by mass, such as 0.10 part by mass to 4.00 parts by mass, relative to 100.00 parts by mass of the toner particles.

Other External Additives

The toner may further contain other additives if necessary. For example, resin or inorganic fine particles may be added which act as a charging adjuvant, a conductivity imparting agent, a fluidity imparting agent, a caking inhibitor, a releasing agent for heat roller fixing, a lubricant, or an abrasive. The lubricant may be polyethylene fluoride powder, zinc stearate powder, or polyvinylidene fluoride powder. Polyvinylidene fluoride powder is advantageous. The abrasive may be cerium oxide powder, silicon carbide powder, or strontium titanate powder. These external additives may be mixed to the toner using a mixer such as a Henschel mixer.

Two-Component Developer

The toner of an embodiment of the invention may be used singly as a single component developer, or may be mixed with a magnetic carrier to be used as a two-component developer.

The magnetic carrier can be selected from among known magnetic materials, such as iron powder whose surfaces may or may not be oxidized, metal particles of iron, lithium, calcium, magnesium, nickel, copper, zinc, cobalt, manganese, rare earth metals or the like, alloy particles and oxide particles of those metals, and ferrite; and magnetic material-dispersed resin carriers (what are called resin carriers) containing a magnetic material and a binder resin holding the magnetic material in a dispersed state.

If the toner is mixed with a magnetic carrier to be used as a two-component developer, the toner content in the developer may be in the range of 2% to 15% by mass.

Manufacturing Method of the Toner

It is advantageous that the toner of the present embodiment contain toner particles produced through melt-kneading of the constituents, from the viewpoint of optimizing the function of the additive C to increase the dispersibility of the releasing agent, and easily producing a toner having high hot offset resistance.

The toner particles may be produced in any process without particular limitation. An exemplary process will be described below.

The toner may be produced in a process using a pulverization method including melt-kneading of an amorphous polyester resin A, a releasing agent B, an additive C, a coloring agent and optional a crystalline polyester resin D, and cooling and solidification of the mixture.

By applying a shear force during melt-kneading, the polyester portion (C1) of the additive C and the amorphous polyester resin A come to be well mixed and the crystalline acrylic portion (C2) of the additive C and the releasing agent B come to be well mixed, and thus the dispersibility of the releasing agent is advantageously increased.

In the step of mixing the raw materials of the toner particles, predetermined amounts of amorphous polyester resin A, releasing agent B, additive C, and a coloring agent, and optionally crystalline polyester resin D and other additives are weighed and mixed together. Examples of the mixer used in this step include double-cone mixers, V-shaped mixers, drum mixers, super mixers, Henschel mixers, Nauta mixers, and Mechano Hybrid manufactured by Nippon Coke & Engineering.

Then, a shear force is applied to the mixture of the materials by melt-kneading the mixture, thereby finely dispersing the releasing agent among the toner particles and dispersing the coloring agent and other materials. For melt-kneading, a kneader may be used such as a pressure kneader, a Banbury mixer or any other batch kneading device, or a continuous kneading device. A single-screw or twin-screw extruder is advantageous for continuous production. Such kneading devices include KTK twin-screw extruder (manufactured by Kobe Steel), TEM twin-screw extruder (manufactured by Toshiba Machine), PCM kneader (manufactured by Ikegai), twin-screw extruder (manufactured by KCK), co-kneader (manufactured by Buss), and Kneadex (manufactured by Nippon Coke & Engineering). The resin composition prepared by melt-kneading may be rolled with a two roll mill or the like, and cooled with water in a cooling step.

The cooled resin composition is pulverized into particles having a desired particle size. The pulverization is performed by roughly crushing the resin composition with a crusher, a hammer mill, a feather mill or the like, and further pulverizing the resin composition with a pulverization apparatus, such as a Kryptron system (manufactured by Kawasaki Heavy Industries), Super Roater (manufactured by Nisshin Engineering), a turbo mill manufactured by Freund Turbo, or an air-jet pulverizer. Then, the pulverized resin composition may optionally be sized to obtain toner particles using a classifier or a sifter, such as an inertial classification classifier Elbow-Jet (Nittetsu Mining), a centrifugal classifier Turboplex (manufactured by Hosokawa Micron), TSP Separator (manufactured by Hosokawa Micron), or Faculty (manufactured by Hosokwawa Micron).

Also, the particles of the pulverized resin composition may optionally be surface-treated for Spheronization or the like with Hybridization system (manufactured by Nara Machinery), Mechanofusion System (manufactured by Hosokawa Micron), Faculty (manufactured by Hosokawa Micron), or Meteorainbow MR (manufactured by Nippon Pneumatic). Furthermore, the pulverized resin composition may optionally be sufficiently mixed with a desired additive using a mixer such as a Henschel mixer, thus yielding the toner.

In the process for producing the toner of the present embodiment, the toner may be subjected to annealing in a process step without particular limitation, so as to further increase the crystallinity thereof. The presence of the additive C in the toner allows the dispersion of the releasing agent B and the crystalline polyester resin D to be maintained even if annealing is performed. From the viewpoint of maintaining the dispersion still better, annealing may be performed at a temperature in the range of 45° C. to 65° C. for a time period in the range of 1 minute to 240 hours.

Evaluation

The physical properties of the toner and the constituents used in the toner: amorphous polyester resin A, releasing agent B, additive C, crystalline polyester resin D are measured as bellow. In after-described Examples, physical properties are measured according to the corresponding method below.

1. Measurement of Weight Average Molecular Weight by Gel Permeation Chromatography (GPC)

For the measurement, a column is stabilized in a heat chamber of 40° C., and the column of this temperature is charged with 100 μL of tetrahydrofuran (THF) at a flow rate of 1 mL/min. In the measurement of a sample, the molecular weight distribution of the sample is calculated from the relationship between the logarithm of the molecular weight and the count value of a calibration curve prepared using some types of monodisperse polystyrene microspheres as reference materials. Polystyrene microspheres having molecular weights in the range of about $10^2$ to $10^7$ manufactured by Tosoh or Showa Denko are suitable as reference materials. It is advantageous to use at least 10 polystyrene reference materials. A refractometer, or refractive index (RI) meter, is used as the detector. The column may be a combination of a plurality of commercially available polystyrene gel columns. Examples of the combination include: showa Denko columns of Shodex GPC KF-801, 802, 803, 804, 805, 806, 807 and 800P, and Tosoh columns of TSK gel G1000H ($H_{XL}$) , G2000H ($H_{XL}$) , G3000H ($H_{XL}$), G4000H ($H_{XL}$), G5000H ($H_{XL}$), G6000H ($H_{XL}$), G7000H ($H_{XL}$) and TSK guard column.

The sample is prepared as below. To 10 mL of THF is added 50.0 mg of a sample, followed by being allowed to stand at 40° C. for 3 hours. Then, the sample is shaken well with the THF until the aggregates of the sample particles disappear, and is then allowed to stand at 40° C. for 12 hours. The total time for which the sample is allowed to stand in THF is set to 24 hours. Then, the sample is passed through a sample treatment filter (having a pore size in the range of 0.2 μm to 0.5μm), such as Myshoridisk H-25-2 (manufactured by Tosoh) to yield a GPC sample. The resin content in the sample is adjusted in the range of 0.5 mg/mL to 5.0 mg/mL.

2. Measurement of the Molecular Weight Mwc2 of Crystalline Acrylic Portion (C2)

First, the weigh average molecular weight Mwc of the additive C and the weight average molecular weight Mwc1 of the polyester portion (C1) are measured by the above-described GPC. Since the content Vc1 (percent by mass) of the polyester portion (C1) and the content Vc2 (percent by mass) of the crystalline acrylic portion (C2) acrylic in the additive C satisfies the equation: Vc1=100−Vc2, the following equation holds true: Mwc2={Mwc−Mwc1×(1−Vc2/100)}×100/Vc2.

Using this equation, the molecular weight Mwc2 of the crystalline acrylic portion (C2) is calculated. In this equation, the weight average molecular weight of the polyester portion (C1) allowing for the content thereof is subtracted from the weight average molecular weight of the additive C, and then the weight average molecular weight of the crystalline acrylic portion (C2) is calculated allowing for the content of the crystalline acrylic portion.

3. Measurements of the Melting Peak Temperatures and Heat of Melting of Releasing Agent B, Additive C, and Crystalline Polyester Resin D Each melting peak temperature of the releasing agent B, additive C and crystalline polyester resin D is defined by the peak temperature corresponding to the maximum endothermic peak in a DSC curve obtained by measurement in accordance with ASTM D3418-82 using a differential scanning calorimeter Q2000 (manufactured by TA Instruments), and the heat of melting is defined by the amount of heat calculated from the area of the endothermic peak.

For the temperature compensation of the detector of the calorimeter, the melting points of indium and zinc are used. The amount of heat is corrected using the heat of melting of indium. More specifically, accurately weighed about 2 mg of a sample is placed in an aluminum pan, and measured at a temperature in the range of −10 to 200° C. at a heating rate of 10° C./min, using an empty aluminum pan as a reference. In this measurement, the sample is heated to 200° C. once and held at this temperature for 1 minute. Subsequently the sample is cooled to −10° C. and then heated again. This second heating step, the temperature in the range of −10 to 200° C. at which the highest endothermic peak is exhibited in the DSC curve is defined as the melting peak temperature, and the heat obtained fusing the peak area is defined as heat of melting.

4. Measurement of Glass Transition Temperature Tg

Glass transition temperature Tg is measured in accordance with ASTM D3418-82 with a differential scanning calorimeter Q2000 (manufacture by TA Instruments). The temperature compensation of the detector, the amount of the sample, and the heating conditions are the same as in the above-described "measurements of melting peak temperatures and heat of melting". A change in specific heat appears in the range of 30° C. to 100° C. during the second heating. Glass transition temperature Tg is defined by the intersection of the differential thermal curve with the line through the midpoints of the baselines before and after a change in specific heat appears.

5. Measurement of Softening Point

The softening point of a sample is measured with a capillary rheometer of a constant-pressure extrusion system using load, Flow Tester CFT-500D (manufactured by Shimadzu), following the manual attached to the tester. In this apparatus, the measuring sample in a cylinder is heated to be melted while a constant load is placed on the measuring sample by a piston. Thus, a rheogram showing the relationship between the downward displacement of the piston and the heating temperature can be prepared by extruding the melted sample from the cylinder.

The melting temperature by the ½ method described in the manual attached to the flow tester CFT-500D is defined as the softening point of the sample. The melting temperature determined by the ½ method is obtained as below. First is calculated a half (X=(Smax−Smin)/2) of the difference between the downward displacement Smax of the piston at the time when the sample has flowed out completely and the downward displacement Smin of the piston at the time when the sample has started flowing. The temperature in the rheogram at which the downward displacement of the piston comes to the sum of X and Smin in the rheogram is defined as the melting temperature measured by the ½ method.

For this measurement, about 1.00 g of a sample is compacted into a cylindrical tablet with a diameter of about 8.0 mm in a tablet forming machine (for example, NT-100H manufactured by NPa System) at about 10.0 MPa over a period of about 60 seconds under an environment of 25° C. This tablet is used as the measuring sample.

The measurement using CFT-500D is performed under the following conditions:

Test mode: heating
Heating rate: 4.0° C./min
Start temperature: 40.0° C.
End-point temperature: 200.0° C.
Cross section of piston: 1.000 $cm^2$
Testing load (piston load): 10.0 kgf (0.9807 MPa)
Preheating time: 300 s
Hole diameter in die: 1.00 mm
Die length: 1.00 mm 6. Measurement of Acid Value The acid values of polyester resins are measured by the following method. The acid value of a sample refers to the milligrams of potassium hydroxide required to neutralize the acid contained in 1 g of the sample. The acid value is measured in accordance with JIS K 0070-1992, and specifically as below.

(1) Preparation of regents

A phenolphthalein solution is prepared by dissolving 1.0 g of phenolphthalein in 90 mL of ethyl alcohol (95 vol %) and adding deionized water up to a total volume of 100 mL. In 5 mL of deionized water, 7 g of highest-quality potassium hydroxide is dissolved, and ethyl alcohol (95 vol %) is added up to a total volume of 1 L. The mixture is allowed to stand for 3 days in an alkali-resistant container so as not to come into contact with carbon dioxide or the like. Then, the mixture is filtered to yield a potassium hydroxide solution. The resulting potassium hydroxide solution is stored in an alkali-resistant container. The factor of the potassium hydroxide solution is determined from the amount of the potassium hydroxide solution used for titration for neutralizing 25 mL of 0.1 mol/L hydrochloric acid solution in a conical flask to which some droplets of the phenolphthalein solution has been added. The 0.1 mol/L hydrochloric acid solution is prepared in accordance with JIS K 8001-1998.

(2) Operation (A) Main Test

To accurately weighed 2.0 g of pulverized polyester resin sample in a 200 mL conical flask, 100 mL of toluene/ethanol (2:1) mixed solution is added, and the sample is dissolved over a period of 5 hours. Subsequently, some droplets of the phenolphthalein solution are added as an indicator, and the resulting solution is titrated with potassium hydroxide solution. The end point of the titration is when the indicator turns pink and the pink color is kept for about 30 seconds.

(B) Blank Test

The same operation as above is performed without using the resin sample (only toluene/ethanol (2:1) mixed solution is titrated).

(3) The Acid Value is Calculated Using the Titration Result and the Following Equation:

$$A=[(C-B)\times f\times 5.611]/S$$

where A represents the acid value (mg KOH/g); B represents the volume (mL) of the potassium hydroxide solution added in the blank test; C represents the volume (mL) of the potassium hydroxide solution added in the main test; f represents the factor of the potassium hydroxide solution; and S represents the weight (g) of the sample.

7. Measurement of Weight-Average Particle Size (D4) of Toner Particles

The weight-average particle size (D4) of the toner particles is measured by a pore electric resistance method with a 100 μm aperture tube, using a precise particle size distribution analyzer "Multisizer 3 Coulter Counter"(registered trademark) manufactured by Beckman Coulter and a software program Multisizer 3 Version 3. 51 supplied from Beckman Coulter with the analyzer for setting measuring conditions and analyzing measurement data. For the measurement and data analysis, the effective number of measurement channels is set to 25,000.

The electrolyte solution used for the measurement is prepared by dissolving highest-quality sodium chloride in deionized water to a concentration of about 1% by mass, and, for example, ISOTONE II (produced by Beckman Coulter) may be used.

Before measurement and analysis, the software program is set up as below.

The total count in the control mode is set to 50000 particles on the "standard measurement (SOM) change screen (in Japanese)" of the software. Also, the number of measurements is set to 1, and Kd is set to a value obtained by use of "10.0 μm standard particles" (produced by Beckman Coulter). On pressing the threshold/noise level measurement button, the threshold and noise level are automatically set. The Current is set to 1600 μA; the Gain, to 2; and the electrolyte solution, to ISOTON II. A check mark is placed at the statement of "flush of aperture tube after measurement (in Japanese)".

On the "Pulse-to-Particle Size Conversion Setting Screen (in Japanese)" of the software, the bin distance is set to logarithmic particle size, the particle size bin to 256 particle size bins, and the particle size range to 2 μm to 60 μm.

Specifically, the measurement is performed according to the following steps (1) to (7):

(1) About 200 mL of the electrolyte solution is placed in a Multisizer-3-specific 250 mL glass round bottom beaker, and stirred with a stirrer rod counterclockwise at 24 rps with the beaker set on a sample stand. The dirt and air bubbles in the aperture tube are removed by the "Aperture Flush" function of the software.

(2) About 30 mL of the electrolyte solution is placed in a 100 mL glass flat bottom beaker, and about 0.3 mL of dispersant "CONTAMINON N" dilute solution is added to the electrolyte solution. CONTAMINON N is a 10% by mass aqueous solution of a pH 7 neutral detergent for precision measurement instruments containing a nonionic surfactant, an anionic surfactant, and an organic binder, produced by Wako Pure Chemical Industries, and the dilute solution of CONTAMINON N is prepared by diluting CONTAMINON N to three times its mass with ion exchanged water.

(3) About 2 mL of CONTAMINON N is added to a predetermine amount of deionized water in a water tank of an ultrasonic dispersion system Tetora 150 (manufactured by Nikkaki Bios) having an electric power of 120 W, containing two oscillators of 50 kHz in oscillation frequency in a state where their phases are shifted by 180°.

(4) The beaker of the above (2) is set to a beaker securing hole of the ultrasonic dispersion system, and the ultrasonic dispersion system is started. Then, the level of the beaker is adjusted so that the resonance of the surface of the electrolyte solution in the beaker can be largest.

(5) In a state where ultrasonic waves are applied to the electrolyte solution in the beaker of (4), about 10 mg of toner is added little by little to the electrolyte solution and dispersed. Such ultrasonic dispersion is further continued for 60 seconds. For the ultrasonic dispersion, the water temperature in the water tank is appropriately controlled in the range of 10° C. to 40° C.

(6) The electrolyte solution of (5), in which the toner is dispersed, is dropped using a pipette into the round bottom beaker of the above (1) set on the sample stand to adjust the measurement concentration to about 5%. Then, the measurement is performed until the number of measured particles comes to 50000.

(7) The measurement data is subjected to analysis of the software to calculate the weight-average particle size (D4). Here, "Average size" on the "Analysis/Volume Statistic Value (Arithmetic Mean) screen (in Japanese)" in a state where graph/% by volume is set on the software refers to the weight average particle diameter (D4).

EXAMPLES

The application will be further described in detail with reference to Examples, which are not intended to limit the embodiments of the application. The term "part(s)" used hereinafter refers to "part(s) by mass". Before the description of Examples, preparation examples of amorphous polyester resin A, additive C and crystalline polyester resin D will be described.

Preparation Example A-1

The raw material monomers in the proportions (on a mole basis) shown in Table 1 were added into a reaction vessel equipped with a nitrogen inlet, a dehydration tube, a stirrer and a thermocouple, and 1.5 parts by mass of dibutyl tin was added relative to the total mass (100 parts by mass) of the raw material monomers. Then, the temperature in the vessel was increased to 160° C. with stirring in a nitrogen atmosphere.

Then, the mixture in the vessel was polycondensated while water was removed by heating the mixture from 160° C. to 200° C. at a heating rate of 10° C./h with stirring. After the inner temperature of the reaction vessel reached 200° C., the vessel was evacuated to 5 kPa or less, and polycondensation was performed under the conditions of 200° C. and 5 kPa or less. The reaction product taken out from the reaction vessel was cooled and pulverized to yield amorphous polyester resin A-1. The physical properties of the resulting amorphous polyester resin A-1 are shown in Table 1.

In order to determine the polycondensation time required to produce a resin having a desired softening point, a pretest was performed. In this pretest, resins were produced by polycondensation of which the time after the evacuation was started was varied several times, and the resins taken out from the vessel, cooled and pulverized were each measured for the softening point. According to the relationship between the polycondensation time and the softening point of the resin obtained by the pretest, the polycondensation time was determined so that the resin can have a softening point shown in Table 1.

Preparation Example A-2

The raw material monomers in the proportions (on a mole basis) shown in Table 1 were added into a reaction vessel equipped with a nitrogen inlet, a dehydration tube, a stirrer and a thermocouple, and 1.5 parts by mass of dibutyl tin was added relative to the total mass (100 parts by mass) of the raw material monomers. Then, the temperature in the vessel was increased to 180° C. with stirring in a nitrogen atmosphere. Then, the mixture in the vessel was polycondensated under normal pressure in a nitrogen atmosphere while water was removed by heating the mixture from 180° C. to 230° C. at a heating rate of 10° C./h with stirring.

After the inner temperature of the reaction vessel reached 230° C., the vessel was evacuated to 5 kPa or less, and polycondensation was performed under the conditions of 230° C. and 5 kPa or less. The reaction product taken out from the reaction vessel was cooled and pulverized to yield amorphous polyester resin A-2. The physical properties of the resulting amorphous polyester resin A-2 are shown in Table 1.

Pretest was performed in the same manner as in Preparation Example A-1, and the polycondensation time was determined according to the relationship between the polycondensation time and the softening point of the resin obtained by the pretest so that the resin can have a softening point shown in Table 1.

TABLE 1

| Polyester resin A | | A-1 | A-2 |
|---|---|---|---|
| Monomer composition (mol %) | Alcohol monomer | | |
| | Bisphenol A-PO 2 mol adduct | 54 | 48 |
| | Bisphenol A-EO 2 mol adduct | | 5 |
| | Acid monomer | | |
| | Terephthalic acid | 45 | 25 |
| | Trimellitic anhydride | 1 | 11 |
| | Adipic acid | | 11 |
| Physical properties of polyester resin A | Tg (° C.) | 57 | 63 |
| | Softening point (° C.) | 92 | 141 |
| | Weight average molecular weight Mwa | 5,800 | 230,000 |
| | Acid value (mg KOH/g) | 8 | 8 |

Preparation Example C-1

An alcohol monomer and an acid monomer in the proportions (on a mole basis) shown in Table 2 were added as the raw material monomers of the polyethylene portion (C1) into a reaction vessel equipped with a nitrogen inlet, a dehydration tube, a stirrer and a thermocouple, and then 1.5 parts by mass of dibutyl tin was added relative to the total mass (100 parts by mass) of the raw material monomers (including bireactive monomers). Then, the temperature in the vessel was increased to 170° C. with stirring in a nitrogen atmosphere.

Then, the mixture in the vessel was polycondensated under normal pressure in a nitrogen atmosphere while water was removed by heating the mixture from 170° C. to 210° C. at a heating rate of 10° C./h with stirring. After the inner temperature of the reaction vessel reached 210° C., the vessel was evacuated to 5 kPa or less, and polycondensation was performed for 3 hours under the conditions of 210° C. and 5 kPa or less to yield an intermediate of the polyester portion.

After reducing the inner pressure of the reaction vessel to normal pressure in a nitrogen atmosphere and the inner temperature thereof to 170° C., the bireactive monomer (maleic anhydride) shown in Table 2 was added into the vessel for an addition reaction. The reaction was performed with stirring at 170° C. for 3 hours. Then, the reaction product taken out of the reaction vessel was cooled and pulverized to yield a polyester portion (C1-1). The physical properties of the resulting polyester portion (C1-1) are shown in Table 2.

Subsequently, 90 parts by mass of the polyester portion (C1-1) was added into a reaction vessel equipped with a nitrogen inlet, a dehydration tube, a stirrer and a thermocouple, and was then melted in a nitrogen atmosphere by increasing the inner temperature of the vessel to 170° C. Then, 10 parts by mass of a raw material monomer of the crystalline acrylic portion (behenyl acrylate) was added to the reaction vessel, and the mixture was stirred well at 170° C. for 2 hours with the inner temperature of the vessel kept at 170° C.

Then, 1.00 part by mass of a polymerization initiator (di-t-butylperoxide) was added and the mixture was stirred for 3 hours with the temperature in the vessel kept at 170° C. Furthermore, the reflux condenser was replaced with a pressure-reducing device and distillation was performed for 2 hours under reduced pressure with the temperature in the vessel kept at 170° C., thus removing low-molecular-weight compounds to yield additive C-1. The physical properties of additive C-1 are shown in Table 2.

Preparation Examples C-2 to C-5

Additives C-2 to C-5 were prepared in the same manner as in Preparation Example C-1 except that the proportions by mass of the raw material monomers, the polyester portion and the crystalline acrylic portion were varied as shown in Table 2. The physical properties of these additives are shown in Table 2.

Preparation Examples C-6 to C-9

Additives C-6 to C-9 were prepared in the same manner as in Preparation Example C-4, except that the temperature in the reaction vessel for polymerizing the crystalline acrylic portion and the amount of the polymerization initiator added were varied as below. The physical properties of these additives are shown in Table 2.

[Preparation Example C-6] vessel inner temperature: 190° C., polymerization initiator: 1.00 part by mass

[Preparation Example C-7] vessel inner temperature: 150° C., polymerization initiator: 1.00 part by mass

[Preparation Example C-8] vessel inner temperature: 190° C., polymerization initiator: 2.00 parts by mass

[Preparation Example C-9] vessel inner temperature: 150° C., polymerization initiator: 0.30 part by mass Preparation Examples C-10 to C-20

Additives C-10 to C-20 were prepared in the same manner as in Preparation Example C-1 except that the proportions by mass of the raw material monomers, the polyester portion and the crystalline acrylic portion were varied as shown in Table 3. The physical properties of these additives are shown in Table 3.

Preparation Example C-21

Additive C-21 was prepared in the same manner as in Preparation Example C-1 except that the proportions by mass of the raw material monomers, the polyester portion and the crystalline acrylic portion were varied as shown in Table 4 and that the bireactive monomer (fumaric acid) was simultaneously added. The physical properties of the resulting additive are shown in Table 4.

Preparation Example C-22

The raw material monomer of the crystalline acrylic portion shown in Table 4 was added into a reaction vessel equipped with a nitrogen inlet, a dehydration tube, a stirrer and a thermocouple, and then melted in a nitrogen atmosphere by increasing the inner temperature of the vessel increased to 170° C. Then, 1 part by mass of a polymerization initiator (di-t-butylperoxide) was added relative to 100 parts by mass of the raw material monomer, and the mixture was stirred for 3 hours with the temperature in the vessel kept at 170° C. Furthermore, the reflux condenser was replaced with a pressure-reducing device and distillation was performed for 2 hours under reduced pressure with the temperature in the vessel kept at 170° C., thus removing low-molecular-weight compounds to yield additive C-22, which is composed of a crystalline acrylic portion (polybehenyl acrylate) without being bound to any polyester portion. The physical properties of additive C-22 are shown in Table 4.

Preparation Example C-23

1. Synthesis of Polyester Portion C1-5

The raw material monomers and a bireactive monomer (fumaric acid) in the proportions shown in Table 4 were added into a reaction vessel equipped with a nitrogen inlet, a dehydration tube, a stirrer and a thermocouple, and 1.0 part by mass of dibutyl tin was added as a catalyst relative to the total mass (100 parts by mass) of the raw material monomers. Then, the temperature in the vessel was increased to 170° C. with stirring in a nitrogen atmosphere. Then, the mixture in the vessel was polycondensated under normal pressure in a nitrogen atmosphere while water was removed by heating the mixture from 170° C. to 210° C. at a heating rate of 10° C./hour with stirring.

After the temperature in the reaction vessel reached 210° C., the vessel was evacuated to 5 kPa or less, and polycondensation was performed under the conditions of 210° C. and 5 kPa or less to yield a polyester portion (C1-5). In this process, the polymerization time after evacuation was adjusted so that the resulting polyester portion (C1-5) could have a weight average molecular weight shown in Table 4.

2. Synthesis of Crystalline Acrylic Portion C2-1

Into a reaction vessel equipped with a nitrogen inlet, a dehydration tube, a stirrer and a thermocouple was added 80 parts by mass (52.3 parts by mole) of behenyl acrylate of the raw material monomers of the crystalline acrylic portion. To this monomer, 100 parts by mass of a toluene solution containing 1.27 parts by mass of 2-methyl-2-[N-(tert-butyl)-N-(1-diethoxyphosphoryl-2,2-dimethylpropyl)-aminoxy]-propionic acid (MBPAP) was added, and was mixed well in a nitrogen gas flow at a vessel inner temperature of 80° C. Subsequently, the behenyl acrylate was polymerized for 8 hours to produce a polybehenyl acrylate block by increasing the temperature in the vessel to 110° C. The molecular weight of the polybehenyl acrylate block was measured by GPC. The number average molecular weight thereof was 20,000.

After varying the temperature in the vessel to 80° C., 20 parts by mass (47.7 parts by mole) of styrene was dropped into the vessel. Then, polymerization was further performed for another 8 hours to extend the molecular chain with the temperature in the vessel increased to 110° C., thus producing crystalline acrylic portion C2-1, which is a polystyrene-polybehenyl acrylate-polystyrene block copolymer. The molecular weight of crystalline acrylic portion C2-1 was measured. The number average molecular weight thereof was 25,000.

The resulting crystalline acrylic portion C2-1 was dissolved in 100 parts by mass of THF, and this solution was taken out and dropped into methanol to precipitate the crystalline acrylic portion C2-1. After being filtered, the precipitate was washed with methanol again and vacuum-dried at 40° C. to yield crystalline acrylic portion C2-1.

3. Grafting of Polyester Portion and Crystalline Acrylic Portion

In 100 parts of toluene were dissolved 77 parts by mass of the polyester portion (C1-5) and 23 parts by mass of the crystalline acrylic portion (C2-1). The solution was heated with stirring for 5 hours in a flask equipped with a cooling tube in a nitrogen gas flow at 120° C.

The resulting polymer was dissolved in 100 parts by mass of THF, and this solution was taken out and dropped into methanol to precipitate the polymer. After being filtered, the precipitate was washed with methanol again and vacuum-dried at 40° C. to yield additive C-23. The physical properties of additive C-23 are shown in Table 4.

Preparation Example C-24

Additive C-24 was prepared in the same manner as in Preparation Example C-23, except that the amounts of the polyester portion (C1-5) and the crystalline acrylic portion (C2-1) used for the grafting of the polyester portion and the crystalline acrylic portion were varied to 90 parts by mass and 10 parts by mass, respectively. The physical properties of additive C-24 are shown in Table 4.

Preparation Examples C-25 and C-26

Additives C-25 and C-26 were prepared in the same manner as in Preparation Example C-21 except that the raw material monomers were replaced as shown in Table 4 and that the bireactive monomer was added simultaneously with the raw material monomers. The physical properties of these additives are shown in Table 4.

Preparation Examples C-27 and C-28

Additives C-27 and C-28 were prepared in the same manner as in Preparation Example C-1 except that the raw material monomers were replaced as shown in Table 4. The physical properties of these additives are shown in Table 4.

Preparation Example C-29

In a reaction vessel equipped with a thermometer and a stirrer were added 1020 parts by mass of xylene and 750 parts of a low-molecular-weight polypropylene (VISCOL 660P produced by Sanyo Chemical Industries, softening point: 145° C.), and the polypropylene was sufficiently dissolved. After the vessel was purged with nitrogen, a solution containing 2385 parts by mass of styrene, 264 parts by mass of acrylonitrile, 330 parts by mass of butyl acrylate, 21 parts by mass of acrylic acid, 32.5 parts by mass of di-t-butylperoxyhexahydroterephthalate and 570 parts by mass of xylene was dropped into the reaction vessel of 175° C. in inner temperature over a period of 3 hours, followed by keeping this temperature in the vessel for 30 minutes. Subsequently, the solvent was removed to yield additive C-29, which is a graft copolymer of polypropylene and vinyl polymer. The mass-average molecular weight of additive C-29 was 8200. The resulting additive was subjected to DSC. A melting peak representing crystallinity was not observed. The glass transition temperature was 57.5° C., and the acid value was 5.0 mg KOH/g.

TABLE 2

| | | Additive C | | | | | | | | |
|---|---|---|---|---|---|---|---|---|---|---|
| | | C-1 | C-2 | C-3 | C-4 | C-5 | C-6 | C-7 | C-8 | C-9 |
| Polyester portion (C1) | | C1-1 | C1-2 | C1-1 | C1-3 | C1-3 | C1-3 | C1-3 | C1-3 | C1-3 |
| Monomer composition (mol %) | Alcohol monomer | | | | | | | | | |
| | Bisphenol A-PO 2 mol adduct | 50 | 25 | 50 | 50 | 50 | 50 | 50 | 50 | 50 |
| | Bisphenol A-EO 2 mol adduct | | 25 | | | | | | | |
| | Acid monomer | | | | | | | | | |
| | Terephthalic acid | 40 | 42 | 40 | 38 | 38 | 38 | 38 | 38 | 38 |
| | Trimellitic anhydride | | | | | | | | | |
| | Dodecenyl succinic anhydride | 4 | 2 | 4 | | | | | | |
| | Adipic acid | | | | 6 | 6 | 6 | 6 | 6 | 6 |
| | Bireactive monomer | | | | | | | | | |
| | Maleic anhydride | 6 | 6 | 6 | 6 | 6 | 6 | 6 | 6 | 6 |
| | Fumaric acid | | | | | | | | | |
| | Acrylic acid | | | | | | | | | |
| Physical properties of polyester portion (C1) | Tg (° C.) | 57 | 57 | 57 | 56 | 56 | 56 | 56 | 56 | 56 |
| | Softening point (° C.) | 97 | 97 | 97 | 97 | 97 | 97 | 97 | 97 | 97 |
| | Weight average molecular weight Mwc1 | 7,000 | 7,300 | 7,000 | 6,800 | 6,800 | 6,800 | 6,800 | 6,800 | 6,800 |
| | Acid value (mg KOH/g) | 20.0 | 15.0 | 20.0 | 20.0 | 20.0 | 20.0 | 20.0 | 20.0 | 20.0 |
| Polycrystalline acrylic portion (C2) | | | | | | | | | | |
| Monomer composition (mol %) | 2-Ethylhexyl acrylate (C8) | | | | | | | | | |
| | Lauryl acrylate (C12) | | | | | | | | | |
| | Stearyl acrylate (C18) | | | | | | | | | |
| | Arachidyl acrylate (C20) | | | | | | | | | |
| | Behenyl acrylate (C22) | 100 | 100 | 100 | 100 | | 100 | 100 | 100 | 100 |
| | Hexacosyl acrylate (C26) | | | | | | | | | |
| | Triacontyl acrylate (C30) | | | | | | | | | |
| | Tetracontyl acrylate (C34) | | | | | | | | | |
| | Stearyl methacrylate (C18) | | | | | | | | | |
| | Behenyl methacrylate (C22) | | | | | 100 | | | | |
| | Styrene | | | | | | | | | |
| Physical property of crystalline acrylic portion (C2) | Weight average molecular weight Mwc2 | 19000 | 28550 | 16000 | 16800 | 14133 | 5800 | 33300 | 4800 | 39300 |
| Crystalline acrylic portion (C2) content (mass %) in additive C | | 10 | 8 | 20 | 15 | 15 | 15 | 20 | 15 | 20 |
| Presence of chemical binding between polyester portion (C1) and crystalline acrylic portion (C2) | | Yes | Yes | Yes | Yes | Yes | Yes | Yes | Yes | Yes |
| Physical properties of additive C | Tg (° C.) | 57.0 | 57.0 | 57.0 | 57.0 | 57.0 | 57.0 | 57.0 | 57.0 | 57.0 |
| | Melting peak temperature Tmc (° C.) | 63.0 | 63.0 | 63.0 | 63.0 | 63.0 | 63.0 | 63.0 | 63.0 | 63.0 |
| | Heat of melting ΔHc (J/g) | 9.0 | 6.0 | 13.0 | 11.0 | 9.0 | 6.0 | 15.0 | 4.0 | 17.0 |
| | Half width Wc (° C.) | 1.1 | 1.4 | 1.8 | 1.4 | 1.8 | 1.7 | 1.4 | 2.5 | 3.0 |
| | Softening point (° C.) | 101 | 100 | 100 | 100 | 100 | 100 | 100 | 97 | 102 |
| | Weight average molecular weight Mwc | 8,200 | 9,000 | 8,800 | 8,300 | 7,900 | 6,650 | 12,100 | 6,500 | 13,300 |
| | Acid value (ng KOH/g) | 15.0 | 10.0 | 10.0 | 13.0 | 13.0 | 13.0 | 10.0 | 13.0 | 10.0 |

TABLE 3

| | | Additive C | | | | | | | | | | |
|---|---|---|---|---|---|---|---|---|---|---|---|---|
| | | C-10 | C-11 | C-12 | C-13 | C-14 | C-15 | C-16 | C-17 | C-18 | C-19 | C-20 |
| Polyester portion (C1) | | C1-3 | C1-3 | C1-3 | C1-3 | C1-3 | C1-3 | C1-3 | C1-3 | C1-3 | C1-3 | C1-3 |
| Monomer composition (mol %) | Alcohol monomer | | | | | | | | | | | |
| | Bisphenol A-PO 2 mol adduct | 50 | 50 | 50 | 50 | 50 | 50 | 50 | 50 | 50 | 50 | 50 |
| | Bisphenol A-EO 2 mol adduct | | | | | | | | | | | |
| | Acid monomer | | | | | | | | | | | |
| | Terephthalic acid | 38 | 38 | 38 | 38 | 38 | 38 | 38 | 38 | 38 | 38 | 38 |
| | Trimellitic anhydride | | | | | | | | | | | |
| | Dodecenyl succinic anhydride | | | | | | | | | | | |
| | Adipic acid | 6 | 6 | 6 | 6 | 6 | 6 | 6 | 6 | 6 | 6 | 6 |
| | Bireactive monomer | | | | | | | | | | | |
| | Maleic anhydride | 6 | 6 | 6 | 6 | 6 | 6 | 6 | 6 | 6 | 6 | 6 |
| | Fumaric acid | | | | | | | | | | | |
| | Acrylic acid | | | | | | | | | | | |

TABLE 3-continued

| | | Additive C | | | | | | | | | | |
|---|---|---|---|---|---|---|---|---|---|---|---|---|
| | | C-10 | C-11 | C-12 | C-13 | C-14 | C-15 | C-16 | C-17 | C-18 | C-19 | C-20 |
| Physical properties of polyester portion (C1) | Tg (° C.) | 56 | 56 | 56 | 56 | 56 | 56 | 56 | 56 | 56 | 56 | 56 |
| | Softening point (° C.) | 97 | 97 | 97 | 97 | 97 | 97 | 97 | 97 | 97 | 97 | 97 |
| | Weight average molecular weight Mwc1 | 6,800 | 6,800 | 6,800 | 6,800 | 6,800 | 6,800 | 6,800 | 6,800 | 6,800 | 6,800 | 6,800 |
| | Acid value (mg KOH/g) | 20.0 | 20.0 | 20.0 | 20.0 | 20.0 | 20.0 | 20.0 | 20.0 | 20.0 | 20.0 | 20.0 |
| Polycrystalline acrylic portion (C2) | | | | | | | | | | | | |
| Monomer composition (mol %) | 2-Ethylhexyl acrylate (C8) | | | | | | | | | | | |
| | Lauryl acrylate (C12) | | | | | | | | | | | |
| | Stearyl acrylate (C18) | | | | | | 5 | 100 | | 5 | 5 | 10 |
| | Arachidyl acrylate (C20) | | | 100 | | | | | | | | |
| | Behenyl acrylate (C22) | 100 | 100 | | | 100 | 95 | | | 95 | 95 | 90 |
| | Hexacosyl acrylate (C26) | | | | 100 | | | | | | | |
| | Triacontyl acrylate (C30) | | | | | | | | 100 | | | |
| | Tetracontyl acrylate (C34) | | | | | | | | | | | |
| | Stearyl methacrylate (C18) | | | | | | | | | | | |
| | Behenyl methacrylate (C22) | | | | | | | | | | | |
| | Styrene | | | | | | | | | | | |
| Physical property of crystalline acrylic portion (C2) | Weight average molecular weight Mwc2 | 23943 | 26800 | 21086 | 24800 | 13200 | 25371 | 23943 | 24800 | 12726 | 30133 | 25371 |
| Crystalline acrylic portion (C2) content (mass %) in additive C | | 7 | 5 | 7 | 5 | 25 | 7 | 7 | 5 | 27 | 3 | 7 |
| Presence of chemical binding between polyester portion (C1) and crystalline acrylic portion (C2) | | Yes | Yes | Yes | Yes | Yes | Yes | Yes | Yes | Yes | Yes | Yes |
| Physical properties of additive C | Tg (° C.) | 57.0 | 56.8 | 56.8 | 56.8 | 56.8 | 56.1 | 55.3 | 55.3 | 56.3 | 56.1 | 56.3 |
| | Melting peak temperature Tmc (° C.) | 63.0 | 63.0 | 57.0 | 67.0 | 63.0 | 60.0 | 47.0 | 76.0 | 61.0 | 59.0 | 59.0 |
| | Heat of melting ΔHc (J/g) | 4.4 | 3.6 | 3.5 | 4.3 | 19.0 | 3.2 | 2.2 | 4.8 | 22.0 | 1.8 | 1.6 |
| | Half width Wc (° C.) | 3.0 | 3.0 | 3.0 | 3.0 | 3.0 | 5.0 | 4.0 | 3.0 | 5.0 | 4.4 | 6.9 |
| | Softening point (° C.) | 100 | 99 | 99 | 99 | 98 | 98 | 98 | 98 | 98 | 98 | 98 |
| | Weight average molecular weight Mwc | 8,000 | 7,800 | 7,800 | 7,700 | 8,400 | 8,100 | 8,000 | 7,700 | 8,400 | 7,500 | 8,100 |
| | Acid value (ng KOH/g) | 17.0 | 18.0 | 16.0 | 18.0 | 8.0 | 15.0 | 16.0 | 18.0 | 5.0 | 17.0 | 16.0 |

TABLE 4

| | | Additive C | | | | | | | |
|---|---|---|---|---|---|---|---|---|---|
| | | C-21 | C-22 | C-23 | C-24 | C-25 | C-26 | C-27 | C-28 |
| Polyester portion (C1) | | C1-4 | | C1-5 | C1-5 | C1-6 | C1-6 | C1-1 | C1-1 |
| Monomer composition (mol %) | Alcohol monomer | | | | | | | | |
| | Bisphenol A-PO 2 mol adduct | 50 | | 25 | 25 | 25 | 25 | 50 | 50 |
| | Bisphenol A-EO 2 mol adduct | | | 25 | 25 | 25 | 25 | | |
| | Acid monomer | | | | | | | | |
| | Terephthalic acid | 38 | | 30 | 30 | 30 | 30 | 40 | 40 |
| | Trimellitic anhydride | | | | | 10 | 10 | | |
| | Dodecenyl succinic anhydride | | | 10 | 10 | | | 4 | 4 |
| | Adipic acid | 6 | | | | | | | |
| | Bireactive monomer | | | | | | | | |
| | Maleic anhydride | | | | | | | 6 | 6 |
| | Fumaric acid | 6 | | 10 | 10 | 5 | 5 | | |
| | Acrylic acid | | | | | 5 | 5 | | |

TABLE 4-continued

| | | Additive C | | | | | | | |
|---|---|---|---|---|---|---|---|---|---|
| | | C-21 | C-22 | C-23 | C-24 | C-25 | C-26 | C-27 | C-28 |
| Physical properties of polyester portion (C1) | Tg (° C.) | 56 | | 57 | 57 | 59 | 59 | 57 | 57 |
| | Softening point (° C.) | 97 | | 110 | 110 | 114 | 114 | 97 | 97 |
| | Weight average molecular weight Mwc1 | 7,300 | | 28,500 | 28,500 | 9,800 | 9,800 | 7,000 | 7,000 |
| | Acid value (mg KOH/g) | 13.0 | | 10.0 | 10.0 | 15.0 | 15.0 | 18.0 | 18.0 |
| Polycrystalline acrylic portion (C2) | | | | C2-1 | C2-1 | | | | |
| Monomer composition (mol %) | 2-Ethylhexyl acrylate (C8) | | | | | | | | |
| | Lauryl acrylate (C12) | | | | | | | 100 | |
| | Stearyl acrylate (C18) | 10 | | | | 15 | | | |
| | Arachidyl acrylate (C20) | | | | | | | | |
| | Behenyl acrylate (C22) | 90 | 100 | 52.3 | 52.3 | | | | |
| | Hexacosyl acrylate (C26) | | | | | | | | |
| | Triacontyl acrylate (C30) | | | | | | | | |
| | Tetracontyl acrylate (C34) | | | | | | | | 100 |
| | Stearyl methacrylate (C18) | | | | | | 10 | | |
| | Behenyl methacrylate (C22) | | | | | | | | |
| | Styrene | | | 47.7 | 47.7 | 85 | 90 | | |
| Physical property of crystalline acrylic portion (C2) | Weight average molecular weight Mwc2 | 27300 | 20000 | 78500 | 73500 | 13300 | 14800 | 18000 | 17000 |
| Crystalline acrylic portion (C2) content (mass %) in additive C | | 7 | 100 | 23 | 10 | 20 | 20 | 10 | 10 |
| Presence of chemical binding between polyester portion (C1) and crystalline acrylic portion (C2) | | Yes | No | No | No | Yes | Yes | Yes | Yes |
| Physical properties of additive C | Tg (° C.) | 56.3 | None | 56.0 | 56.0 | 59.0 | 60.0 | 56.3 | 56.3 |
| | Melting peak temperature Tmc (° C.) | 59.0 | 63.0 | 63.0 | 63.0 | None | None | 40.0 | 81.0 |
| | Heat of melting ΔHc (J/g) | 1.3 | 81.0 | 4.0 | 1.3 | None | None | 1.2 | 7.0 |
| | Half width Wc (° C.) | 7.8 | 2.1 | 9.1 | 7.3 | None | None | 7.1 | 4.3 |
| | Softening point (° C.) | 98 | 68 | 114 | 113 | 115 | 117 | 94 | 100 |
| | Weight average molecular weight Mwc | 8,700 | 20,000 | 40,000 | 33,000 | 10,500 | 10,800 | 8,100 | 8,000 |
| | Acid value (ng KOH/g) | 11.0 | — | 7.0 | 7.0 | 11.0 | 12.0 | 13.0 | 13.0 |

Preparation Example D-1

A reaction vessel equipped with a nitrogen inlet, a dehydration tube, a stirrer and a thermocouple was charged with 1,10-decanediol as an alcohol monomer of the polyester molecular chain (D1) and 1,10-decanedioic acid as an acid monomer, each in the amount shown in Table 5. Subsequently, 0.8 part by mass of tin dioctylate was added as a catalyst to 100 parts by mass of the total monomer, and a reaction was performed for 7 hours under normal pressure while water was removed by increasing the temperature in the vessel to 140° C. Subsequently, a reaction was performed while the temperature in the vessel was increased to 200° C. at a heating rate of 10° C./h. After the temperature reached 200° C., reaction was further conducted for 2 hours after the reaction vessel was evacuated to 5 kPa or less at 200° C.

Then, the pressure in the reaction vessel was gradually returned to normal pressure, and a monomer (n-octadecanoic acid) shown in Table 5 for forming the alkyl portion (D2) was added. The mixture was allowed to react under normal pressure at 200° C. for 1.5 hours. The reaction vessel was evacuated again to 5 kPa or less at 200° C., and a reaction was performed at 200° C. for 2.5 hours to yield crystalline polyester resin D-1.

The physical properties of the resulting crystalline polyester resin D-1 are shown in Table 5. The MALDI-TOFMS mass spectrum of this resin exhibited a peak of a structure in which n-octadecanoic acid was bound to an end of a polyester molecular chain (D1). It was thus confirmed that crystalline polyester resin D-1 has a structure in which an alkyl portion (D2) is bound to an end of a polyester molecular chain (D1).

TABLE 5

| Crystalline polyester resin | Polyester molecular chain (D1) | | | | Alkyl portion (D2) | | Physical properties of crystalline polyester resin D | | | |
|---|---|---|---|---|---|---|---|---|---|---|
| | Alcohol component | mol % | Acid component | mol % | Monomer | mol % | Melting peak temp. ° C. | ΔHd J/g | Mwc — | Acid value mg KOH/g |
| D-1 | 1,10-Decanediol | 49.0 | 1,10-Decanedioic acid | 49.0 | n-Octadecanoic acid | 2.0 | 75 | 129 | 21000 | 2 |
| D-2 | 1,12-Dodecanediol | 47.5 | 1,10-Decanedioic acid | 47.5 | 1-Octadecanol | 5.0 | 82 | 125 | 19000 | 2 |

TABLE 5-continued

| Crystalline polyester resin | Polyester molecular chain (D1) Alcohol component | mol % | Acid component | mol % | Alkyl portion (D2) Monomer | mol % | Physical properties of crystalline polyester resin D: Melting peak temp. ° C. | ΔHd J/g | Mwc — | Acid value mg KOH/g |
|---|---|---|---|---|---|---|---|---|---|---|
| D-3 | 1,12-Dodecanediol | 49.5 | 1,6-Hexanedioic acid | 49.5 | 1-Tetradecanol | 1.0 | 74 | 120 | 39000 | 2 |
| D-4 | 1,6-Hexanediol | 49.0 | 1,12-Dodecanedioic acid | 49.0 | n-Triacontanoic acid | 2.0 | 72 | 116 | 28000 | 2 |
| D-5 | 1,10-Decanediol | 50.0 | 1,10-Decanedioic acid | 50.0 | | | 73 | 99 | 28000 | 10 |
| D-6 | 1,6-Hexanediol | 50.0 | Fumaric acid | 50.0 | | | 105 | 81 | 24000 | 12 |

Preparation Examples D-2 to D-6

Crystalline polyester resins D-2 to D-6 were prepared in the same manner as in Preparation Example D-1, except that the monomer of the polyester molecular chain (D1) and the monomer of the alkyl portion (D2) and the amount thereof were replaced according to Table 5. The physical properties of the resulting crystalline polyester resins are shown in Table 5.

The MALDI-TOFMS mass spectra of these resins each exhibited a peak of a structure in which an alkyl portion (D2) monomer was bound to an end of a polyester molecular chain (D1). It was thus confirmed that each of crystalline polyester resins D-2 to D-4 have a structure in which an alkyl portion (D2) is bound to an end of a polyester molecular chain (D1).

Example 1

Materials were mixed in a Henschel mixer (FM-75 manufactured by Mitsui Miike Engineering) according to Table 6. The mixture was kneaded with a twin screw kneader (PCM-30 manufactured by Ikegai) at a rotation speed of 3.3 rps. The temperature of the kneader barrel was controlled so that the kneaded resin could come to the temperature of 20° C. higher than the softening point of amorphous polyester resin A-2.

TABLE 6

| Material | Amount (parts by mass) |
|---|---|
| Polyester resin A-1 | 58.0 |
| Polyester resin A-2 | 30.0 |
| Additive C-1 | 4.0 |
| Crystalline polyester resin D-1 | 8.0 |
| Carbon black | 5.0 |
| Releasing agent: Fischer-Tropsch Wax 1 (melting point: 77° C.) | 5.0 |
| Aluminum 3,5-di-t-butyl salicylate | 0.5 |

The kneaded product was cooled and roughly crushed to 1 mm or less with a hammer mill. The crushed product was pulverized to much lower particle sizes with a mechanical pulverizer (T-250 manufactured by Freund Turbo). The pulverized powder particles were sized with a multi-classification classifier using the Coanda effect, and thus negatively triboelectrically charged particles having a weight-average particle size (D4) of 7.1 μm were produced.

To 100 parts by mass of the toner particles was added 1.0 part by mass of titanium oxide fine particles having a primary average particle size of 50 nm that had been surface-treated with 15% by mass of isobutyltrimethoxysilane, and 0.8 part by mass of hydrophobic silica fine particles having a primary average particle size of 16 nm that had been surface-treated with 20% by mass of hexamethyldisilazane. The materials were mixed with a Henschel mixer (FM-75 manufactured by Mitsui Miike Engineering) to yield toner 1. The composition of toner 1 is shown in Table 7.

Examples 2 to 31, Comparative Examples 1 to 11

Toners 2 to 31 (Examples 2 to 31) and toners 32 to 42 (Comparative Examples 1 to 11) were produced in the same manner as in Example 1, except the composition of the toner was changed according to Table 7.

TABLE 7

| | Toner No. | Polyester resin A Type | Parts by mass | Releasing agent B Type | Tmb ° C. | Parts by mass | Additive C Type | Tmc ° C. | Parts by mass | Crystalline polyester resin D Type | Parts by mass | Tmb − Tmc ° C. |
|---|---|---|---|---|---|---|---|---|---|---|---|---|
| Example 1 | Toner 1 | A-1/A-2 | 58/30 | Fischer-Tropsch Wax 1 | 77.0 | 5 | C-1 | 63.0 | 4 | D-1 | 8 | 14.0 |
| Example 2 | Toner 2 | A-1/A-2 | 59/30 | Fischer-Tropsch Wax 1 | 77.0 | 5 | C-2 | 63.0 | 3 | D-2 | 8 | 14.0 |

TABLE 7-continued

| | | Polyester resin A | | Releasing agent B | | | Additive C | | | Crystalline polyester resin D | | |
|---|---|---|---|---|---|---|---|---|---|---|---|---|
| | Toner No. | Type | Parts by mass | Type | Tmb ° C. | Parts by mass | Type | Tmc ° C. | Parts by mass | Type | Parts by mass | Tmb − Tmc ° C. |
| Example 3 | Toner 3 | A-1/A-2 | 48/30 | Fischer-Tropsch Wax 1 | 77.0 | 3 | C-3 | 63.0 | 2 | D-1 | 20 | 14.0 |
| Example 4 | Toner 4 | A-1/A-2 | 52/30 | Fischer-Tropsch Wax 1 | 77.0 | 10 | C-4 | 63.0 | 10 | D-3 | 8 | 14.0 |
| Example 5 | Toner 5 | A-1/A-2 | 44/30 | Behenyl behenate | 71.0 | 5 | C-5 | 55.0 | 18 | D-4 | 8 | 16.0 |
| Example 6 | Toner 6 | A-1/A-2 | 57/30 | Fischer-Tropsch Wax 1 | 77.0 | 5 | C-6 | 63.0 | 5 | D-1 | 8 | 14.0 |
| Example 7 | Toner 7 | A-1/A-2 | 60/30 | Fischer-Tropsch Wax 1 | 77.0 | 5 | C-7 | 63.0 | 2 | D-1 | 8 | 14.0 |
| Example 8 | Toner 8 | A-1/A-2 | 57/30 | Fischer-Tropsch Wax 1 | 77.0 | 5 | C-8 | 63.0 | 5 | D-1 | 8 | 14.0 |
| Example 9 | Toner 9 | A-1/A-2 | 60/30 | Fischer-Tropsch Wax 1 | 77.0 | 5 | C-9 | 63.0 | 2 | D-1 | 8 | 14.0 |
| Example 10 | Toner 10 | A-1/A-2 | 58/30 | Fischer-Tropsch Wax 1 | 77.0 | 5 | C-10 | 63.0 | 4 | D-1 | 8 | 14.0 |
| Example 11 | Toner 11 | A-1/A-2 | 58/30 | Fischer-Tropsch Wax 1 | 77.0 | 5 | C-11 | 63.0 | 4 | D-1 | 8 | 14.0 |
| Example 12 | Toner 12 | A-1/A-2 | 58/30 | Fischer-Tropsch Wax 1 | 77.0 | 5 | C-12 | 57.0 | 4 | D-1 | 8 | 20.0 |
| Example 13 | Toner 13 | A-1/A-2 | 58/30 | Fischer-Tropsch Wax 2 | 70.0 | 5 | C-13 | 67.0 | 4 | D-1 | 8 | 3.0 |
| Example 14 | Toner 14 | A-1/A-2 | 58/30 | Fischer-Tropsch Wax 3 | 90.0 | 5 | C-10 | 63.0 | 4 | D-1 | 8 | 27.0 |
| Example 15 | Toner 15 | A-1/A-2 | 58/30 | Fischer-Tropsch Wax 3 | 90.0 | 5 | C-14 | 63.0 | 4 | D-1 | 8 | 27.0 |
| Example 16 | Toner 16 | A-1/A-2 | 61/30 | Fischer-Tropsch Wax 3 | 90.0 | 5 | C-10 | 63.0 | 4 | D-1 | 5 | 27.0 |
| Example 17 | Toner 17 | A-1/A-2 | 61/30 | Fischer-Tropsch Wax 3 | 90.0 | 5 | C-10 | 63.0 | 4 | D-5 | 5 | 27.0 |
| Example 18 | Toner 18 | A-1/A-2 | 66/30 | Fischer-Tropsch Wax 3 | 90.0 | 5 | C-10 | 63.0 | 4 | | | 27.0 |
| Example 19 | Toner 19 | A-1/A-2 | 66/30 | Fischer-Tropsch Wax 3 | 90.0 | 5 | C-15 | 60.0 | 4 | | | 30.0 |
| Example 20 | Toner 20 | A-1/A-2 | 58/30 | Fischer-Tropsch Wax 2 | 70.0 | 5 | C-16 | 47.0 | 4 | D-1 | 8 | 23.0 |
| Example 21 | Toner 21 | A-1/A-2 | 58/30 | Fischer-Tropsch Wax 4 | 80.0 | 5 | C-17 | 76.0 | 4 | D-1 | 8 | 4.0 |
| Example 22 | Toner 22 | A-1/A-2 | 58/30 | Fischer-Tropsch Wax 1 | 77.0 | 5 | C-16 | 47.0 | 4 | D-1 | 8 | 30.0 |
| Example 23 | Toner 23 | A-1/A-2 | 58/30 | Fischer-Tropsch Wax 1 | 77.0 | 5 | C-17 | 76.0 | 4 | D-1 | 8 | 1.0 |
| Example 24 | Toner 24 | A-1/A-2 | 66/30 | Fischer-Tropsch Wax 3 | 90.0 | 5 | C-18 | 61.0 | 4 | | | 29.0 |
| Example 25 | Toner 25 | A-1/A-2 | 50/30 | Fischer-Tropsch Wax 3 | 90.0 | 5 | C-18 | 61.0 | 20 | | | 29.0 |
| Example 26 | Toner 26 | A-1/A-2 | 48/30 | Fischer-Tropsch Wax 3 | 90.0 | 5 | C-18 | 61.0 | 22 | | | 29.0 |
| Example 27 | Toner 27 | A-1/A-2 | 66/30 | Fischer-Tropsch Wax 3 | 90.0 | 5 | C-19 | 59.0 | 4 | | | 31.0 |
| Example 28 | Toner 28 | A-1/A-2 | 68/30 | Fischer-Tropsch Wax 3 | 90.0 | 5 | C-19 | 59.0 | 2 | | | 31.0 |
| Example 29 | Toner 29 | A-1/A-2 | 69/30 | Fischer-Tropsch Wax 3 | 90.0 | 5 | C-19 | 59.0 | 1 | | | 31.0 |
| Example 30 | Toner 30 | A-1/A-2 | 66/30 | Fischer-Tropsch Wax 3 | 90.0 | 5 | C-20 | 59.0 | 4 | | | 31.0 |
| Example 31 | Toner 31 | A-1/A-2 | 66/30 | Fischer-Tropsch Wax 3 | 90.0 | 5 | C-21 | 59.0 | 4 | | | 31.0 |
| Comparative Example 1 | Toner 32 | A-1/A-2 | 66/30 | Fischer-Tropsch Wax 1 | 77.0 | 5 | | | | | | |
| Comparative Example 2 | Toner 33 | A-1/A-2 | 66/30 | Fischer-Tropsch Wax 1 | 77.0 | 5 | C-22 | 63.0 | 4 | | | 14.0 |
| Comparative Example 3 | Toner 34 | A-1/A-2 | 66/30 | Fischer-Tropsch Wax 3 | 90.0 | 5 | C-23 | 63.0 | 4 | | | 27.0 |
| Comparative Example 4 | Toner 35 | A-1/A-2 | 66/30 | Fischer-Tropsch Wax 3 | 90.0 | 5 | C-24 | 63.0 | 4 | | | 27.0 |
| Comparative Example 5 | Toner 36 | A-1/A-2 | 66/30 | Fischer-Tropsch Wax 1 | 77.0 | 5 | C-25 | None | 4 | | | |
| Comparative Example 6 | Toner 37 | A-1/A-2 | 66/30 | Fischer-Tropsch Wax 1 | 77.0 | 5 | C-26 | None | 4 | | | |
| Comparative Example 7 | Toner 38 | A-1/A-2 | 66/30 | Fischer-Tropsch Wax 2 | 70.0 | 5 | C-27 | 40.0 | 4 | | | 30.0 |
| Comparative Example 8 | Toner 39 | A-1/A-2 | 66/30 | Fischer-Tropsch Wax 1 | 77.0 | 5 | C-28 | 81.0 | 4 | | | −4.0 |
| Comparative Example 9 | Toner 40 | A-1/A-2 | 61/30 | Fischer-Tropsch Wax 2 | 70.0 | 5 | C-27 | 40.0 | 4 | D-5 | 5 | 30.0 |
| Comparative Example 10 | Toner 41 | A-1/A-2 | 61/30 | Fischer-Tropsch Wax 1 | 77.0 | 5 | C-28 | 81.0 | 4 | D-6 | 5 | −4.0 |
| Comparative Example 11 | Toner 42 | A-1/A-2 | 66/30 | Fischer-Tropsch Wax 1 | 77.0 | 5 | C-29 | None | 4 | | | |

Example 101

1. Preparation of Magnetic Carrier

To magnetite fine particles having a number average particle size of 0.30 μm (magnetization intensity in a magnetic field of 10000/4π kA/m: 75 Am/kg, specific resistance: $5\times10^7$ Ω·cm), 3.5% by mass of a silane coupling agent 3-(2-aminoethylaminopropyl)trimethoxysilane was added, and also 2.0% by mass of the same silane coupling agent was added to hematite fine particles having a number average particle size of 0.30 μm (specific resistance: $3\times10^8$ Ω·cm). The fine particles in each vessel were lipophilized at 120° C. or more by high-speed agitation.

TABLE 8

| Material | Amount (parts by mass) |
|---|---|
| Phenol | 10 |
| 37 mass % Formaldehyde aqueous solution | 6 |
| Lipophilized magnetite fine particles | 74 |
| Lipophilized hematite fine particles | 10 |
| 28 mass % Ammonia solution | 5 |
| Water | 10 |

Subsequently, the materials shown in Table 8 were placed in a flask. The materials were then heated to 85° C. over a period of 60 minutes and held in the flask while being stirred and mixed, thus being polymerized at 85° C. for 3 hours to yield a cured phenol resin. After the cured phenol resin was cooled to 30° C., water was added to the resin, and then the supernatant liquor was removed. The sediment was rinsed with water and dried in the air. Subsequently, the sediment was further dried under reduced pressure (5 hPa or less) at 60° C. to yield magnetic particle-dispersed resin core M-1 that was in a state in which magnetic fine particles were dispersed. The resulting magnetic particle-dispersed resin core M-1 had a number average particle size of 34 μm and a BET specific surface area of 0.07 $m^2/g$.

2. Preparation of Magnetic Carrier

Next, a magnetic carrier was prepared using the following materials and the following procedure.

Magnetic particle-dispersed resin core M-1: 100 parts by mass

Acrylic resin: 1.0 part by mass

First, a coating liquid was prepared by dissolving the acrylic resin in toluene so that the coating liquid contained 10% by mass of solid. Subsequently, the surfaces of the particles of resin core M-1 were coated with the coating liquid using a coating apparatus (Nauta Mixer NX-10 manufactured by Hosokawa Micron). After being dried by heating at 100° C. for 4 hours in a vacuum drier, the particles of the core were sieved through a #200 mesh to yield magnetic carrier 1.

The acrylic resin was prepared as below. Into a four-neck flask equipped with a reflux condenser, a thermometer, a nitrogen inlet and a grinding agitator were added 50 parts by mass of methyl methacrylate monomer and 50 parts by mass of cyclohexyl methacrylate monomer. Into the same flask were further added 90 parts by mass of toluene, 110 parts by mass of methyl ethyl ketone, and 2.0 parts by mass of azobisisovaleronitrile. The resulting mixture was held at 70° C. in a nitrogen gas flow for 10 hours for polymerization. After the completion of the polymerization reaction, the product was washed some times to yield the acrylic resin. The acrylic resin had a weight average molecular weight of 50,000 and a transition temperature Tg of 90° C.

3. Production of two-component developer

Toner 1 and Magnetic Carrier 1 were mixed using a V-shaped mixer so that the toner content would be 10% by mass, thus producing two-component developer 1.

4. Evaluation of two-component developer

The resulting two-component developer was evaluated in terms of the following properties (1) to (4). For each test, a test apparatus modified from a commercially available imageRUNNER ADVANCE (iR-ADV C5250, manufactured by Canon) was used. For the measurements of (1) to (3), this test apparatus was further modified so that the sleeve of the fuser could have a surface temperature of 160° C. and the process speed could be 384 mm/s. In the measurement of (2), an external blank rotation apparatus modified so that the number of rotations could be arbitrarily varied was used for blank rotation test. For the measurement of (4), the fuser of the above-described modified test apparatus was replaced with an alternative external fuser that had been produced separately.

(1) High-Temperature Durability (Density Maintenance Rate After Blank Rotation)

The developing unit at the black station was taken out of the modified test apparatus, and the developer was removed. After being cleaned, the developing unit was charged with 250 g of the above-produced two-component developer 1 and then mounted to the modified apparatus, followed by initialization. For the magenta, yellow and cyan stations, each toner of the original apparatus was removed, and magenta, yellow and cyan developing units in which the mechanism for detecting the amount of remaining toner was turned invalid were mounted to the modified apparatus.

An initial image was formed on a laser Copia paper sheet (Canon GF-0081, A4 sized sheet with a basis weight of 81.4 $g/m^2$) under conditions of 32.5° C. in temperature and 95% in relative humidity. In this operation, a 50 mm×50 mm solid pattern with a margin of 10 mm was output as the initial image, and the potential was controlled so that the initial image density could be 1.50. For measuring the image density, X-Rite 500 series (manufactured by X-Rite, density measurement mode) was used.

Then, the developing unit removed from the modified test apparatus was set to the external blank rotation apparatus, and blank rotation was performed for 3 hours in a thermostatic chamber of 42° C. in temperature and 41% in relative humidity. In this test, the rotation speed of the external blank rotation apparatus was set so that the process speed would be 384 mm/s.

After the 3-hour blank rotation, the developing unit was removed from the external blank rotation apparatus. Then, the developing unit was mounted to the modified apparatus, and an image was output at the same potential as for the initial image under the conditions of 32.5° C. in temperature and 95% in relative humidity. The density of the image was measured as the "image density after blank rotation".

The image density after blank rotation was divided by the initial image density and the quotient was multiplied by 100 to yield the density maintenance rate after blank rotation. The high-temperature durability was ranked as any of A to D according to the following criteria.

In the present disclosure, ranks up to C are acceptable.

A: density maintenance rate after blank rotation was less than 10% (excellent)

B: density maintenance rate after blank rotation was 10% or more and less than 20% (good)

C: density maintenance rate after blank rotation was 20% or more and less than 30% (rather good)

D: density maintenance rate after blank rotation was less than 30% (the same level as known products)

(2) Hot Offset Resistance in Two-Side Printing (Degree of Fogging Depending on the Type of Paper)

Hot offset resistance in two-side printing was measured with the modified apparatus under the conditions of 23° C. in temperature and 50% in relative humidity using the following test paper sheets (three types having different basis weights).

Canon CS520: A4-sized paper sheet with a basis weight of 52 $g/m^2$

Canon GF600: A4-sized paper sheet with a basis weight of 60 $g/m^2$

Canon GF680: A4-sized paper sheet with a basis weight of 68 $g/m^2$

The developing unit at the black station was taken out, and the developer was removed. After being cleaned, the developing unit was charged with 250 g of the above-produced two-component developer 1 and then mounted to the modified apparatus, followed by initialization. Then, a test pattern with a margin of 10 mm and a 20 mm×20 mm half tone image (dot ratio: 23%, amount of toner deposited: 0.10 $mg/cm^2$) was output on the rear side of each test paper sheet in a two-side printing mode, and subsequently a blank sheet was output under the same conditions.

The "degree of fogging" over the white area in the half toner image of the test pattern was measured to evaluate the hot offset resistance in two-side printing.

The degree of fogging was measured as below. The reflectances of the white area in the test pattern corresponding to the second rotation of the fuser and the blank sheet output under the same conditions were measured at 5 points each with a digital white light photometer (TC-6D, produced by Tokyo Denshoku, using a green filter). Thus the average reflectance was calculated for each of the test pattern and the blank sheet. The degree (%) of fogging was defined by the difference in average reflectance (%) between the blank sheet and the test pattern.

Toners exhibited low degree of fogging even on a thinner sheet were evaluated to be good in terms of hot offset resistance in two-side printing. The results were ranked as any of A to D according to the following criteria. In the present disclosure, ranks up to C are acceptable.

A: When the degree of fogging on a sheet of 52 g/m$^2$ in basis weight was less than 1.0%. (excellent)

B: When the degree of fogging was 1.0% or more on a sheet of 52 g/m$^2$ in basis weight and less than 1.0% on a sheet of 60 g/m$^2$ in basis weight. (good)

C: When the degree of fogging was 1.0% or more on a sheet of 60 g/m$^2$ in basis weight and less than 1.0% on a sheet of 68 g/m$^2$ in basis weight. (rather good)

D: When the degree of fogging on a sheet of 68 g/m$^2$ in basis weight was 1.0% or more. (the same level as known products)

(3) Gloss Uniformity in Two-Side Printing (Rate of Change of Gloss Between the Front Side and the Rear Side)

Gloss uniformity in two-side printing was measured with the modified apparatus under the conditions of 23° C. in temperature and 50% in relative humidity using the following test paper sheets.

The developing unit at the black station was taken out, and the developer was removed. After being cleaned, the developing unit was charged with 250 g of the above-produced two-component developer 1 and then mounted to the modified apparatus, followed by initialization. For the magenta, yellow and cyan stations, each toner of the original apparatus was removed, and magenta, yellow and cyan developing units in which the mechanism for detecting the amount of remaining toner was turned invalid were mounted to the modified apparatus.

Laser Copia paper sheets (Canon GF-C081: A4 size with a basis weight of 81.4 g/m$^2$) were used as the test paper sheets. In this operation, a 50 mm×50 mm solid pattern with a margin of 10 mm was output on the front and the rear side of the test sheet, and the potential was controlled so that the image density on the front side could be 1.50.

Images were output under conditions of 32.5° C. in temperature and 95% in relative humidity.

The 60° gloss values of the solid patterns on the front and rear sides were measured with a handy gloss meter (PG-1M, manufactured by Tokyo Denshoku) at 5 points each, and the results were averaged. The difference in average gloss value between the front and rear sides was divided by the average gloss value of the rear side and the quotient was multiplied by 100 to yield the rate (%) of change in gloss between the front side and the rear side.

Toners exhibited lower rate of change in gloss were evaluated to be better in gloss uniformity in two-side printing. The results were ranked as any of A to D according to the following criteria. In the present disclosure, ranks up to C are acceptable.

A: When the rate (%) of change in gloss between the front and the rear side was less than 10%. (excellent)

B: When the rate (%) of change in gloss between the front and the rear side was 10% or more and less than 20%. (good)

C: When the rate (%) of change in gloss between the front and the rear side was 20% or more and less than 30%. (rather good)

D: When the rate (%) of change in gloss between the front and the rear side was 30% or more. (the same level as known products)

(4) Fixability (Density Decrease Depending on the Type of Paper)

The fuser of the test apparatus was replaced with an external fuser adapted to arbitrarily set the fixing temperature, fixing nip surface pressure and process speed thereof.

Tests for the evaluation of fixability were performed under the conditions of 23° C. in temperature and 50% in relative humidity with a sleeve surface temperature of the external fuser of 160° C., a fuser nip surface pressure of 0.13 MPa, and a process speed of 384 mm/s, using the following test paper sheets (three types having different basis weights).

GF-C157: A4-sized paper sheet with a basis weight of 157 g/m$^2$

Color Laser NPI high-quality paper sheet: A4-sized paper sheet with a basis weight of 128 g/m$^2$ GF-C104: A4-sized paper sheet with a basis weight of 104 g/m$^2$ Unfixed images were output as below. The original toners were removed from the developing units of the cyan and black stations of the test apparatus, and the insides of the developer units were cleaned by air blowing. Then, each developing unit was charged with 250 g of the above-described two-component developer 1 and mounted to the test apparatus. For the yellow and magenta stations, each developer of the original apparatus was removed, and yellow and magenta developing units in which the mechanism for detecting the amount of remaining toner was turned invalid were mounted to the test apparatus.

Then, a 50 mm×50 mm solid black unfixed pattern with a margin of 10 mm was output on each test paper sheet so that the amount of toner deposited on the sheet would be 0.90 mg/cm$^2$.

The sheet having the unfixed pattern was passed through the external fuser to yield a fixed pattern.

The density of the black solid portion of the resulting fixed pattern was measured at five points, and the averaged density was defined as the initial density.

Then, a polyester tape (No. 5515 manufactured by Nichiban) was stuck on the black solid portion, and the solid portion was allowed to adhere to the polyester tape by reciprocally moving a load of 100 g three times on the polyester tape. After the polyester tape was removed, the image density of the fixed pattern was measured at 5 points, and the averaged density was defined as density after tape removal. For measuring the image density, X-Rite 500 series (manufactured by X-Rite, density measurement mode) was used.

Then, density maintenance rate (%) after tape removal was calculated by dividing the difference between the initial density and the density after tape removal by the initial density and multiplying the quotient by 100.

Toners exhibited low density maintenance rates (%) after tape removal even on a thick paper sheet were evaluated to be good in terms of fixability. The results were ranked as any of A to D according to the following criteria. In the present disclosure, ranks up to C are acceptable.

A: When the density maintenance rate (%) after tape removal was less than 10.0% on a sheet of 157 g/m$^2$ in basis weight. (Excellent)

B: When the density maintenance rate (%) after tape removal was 10.0% or more on a sheet of 157 g/m$^2$ in basis weight and less than 10.0% on a sheet of 128 g/m$^2$ in basis weight. (good)

C: When the density maintenance rate (%) after tape removal was 10.0% or more on a sheet of 128 g/m$^2$ in basis weight and less than 10.0% on a sheet of 104 g/m$^2$ in basis weight. (rather good)

D: When the density maintenance rate (%) after tape removal was 10.0% or more on a sheet of 104 g/m$^2$ in basis weight. (the same level as known products)

The results of tests (1) to (4) in Example 101 were good. The results are shown in Table 9.

Examples 102 to 131, Comparative Examples 101 to 111

Two-component developers 102 to 131 (Examples 102 to 131) and two-component developers 132 to 142 (Comparative Examples 101 to 111) were produced in the same manner as in Example 101, except that the toner was replaced as shown in Table 9. The results are shown in Table 9.

TABLE 9

| | Two-component developer | Toner | Magnetic carrier | High-temperature durability Blank rotation Density maintenance rate (%) | Hot offset resistance Paper type Degree of fogging (%) | Gloss uniformity In Two-side printing Rate of gloss change | Fixability Paper type Density maintenance rate after tape removal |
|---|---|---|---|---|---|---|---|
| Example 101 | 101 | Toner-1 | Carrier 1 | A (3%) | A (0.3%) | A (3%) | A (1%) |
| Example 102 | 102 | Toner-2 | Carrier 1 | A (3%) | A (0.3%) | A (3%) | A (1%) |
| Example 103 | 103 | Toner-3 | Carrier 1 | A (4%) | A (0.3%) | A (3%) | A (1%) |
| Example 104 | 104 | Toner-4 | Carrier 1 | A (5%) | A (0.3%) | A (3%) | A (1%) |
| Example 105 | 105 | Toner-5 | Carrier 1 | A (5%) | A (0.3%) | A (3%) | A (1%) |
| Example 106 | 106 | Toner-6 | Carrier 1 | A (9%) | A (0.3%) | A (3%) | A (1%) |
| Example 107 | 107 | Toner-7 | Carrier 1 | A (6%) | A (0.9%) | A (3%) | A (1%) |
| Example 108 | 108 | Toner-8 | Carrier 1 | B (11%) | A (0.4%) | A (3%) | A (1%) |
| Example 109 | 109 | Toner-9 | Carrier 1 | A (7%) | B (0.3%) | A (3%) | A (1%) |
| Example 110 | 110 | Toner-10 | Carrier 1 | B (13%) | B (0.3%) | A (3%) | A (1%) |
| Example 111 | 111 | Toner-11 | Carrier 1 | B (12%) | B (0.3%) | A (3%) | A (1%) |
| Example 112 | 112 | Toner-12 | Carrier 1 | B (12%) | B (0.3%) | A (8%) | A (1%) |
| Example 113 | 113 | Toner-13 | Carrier 1 | B (13%) | B (0.3%) | A (9%) | A (1%) |
| Example 114 | 114 | Toner-14 | Carrier 1 | B (12%) | B (0.3%) | B (12%) | A (1%) |
| Example 115 | 115 | Toner-15 | Carrier 1 | B (12%) | B (0.3%) | B (12%) | A (1%) |
| Example 116 | 116 | Toner-16 | Carrier 1 | B (12%) | B (0.3%) | B (12%) | A (7%) |
| Example 117 | 117 | Toner-17 | Carrier 1 | B (13%) | B (0.3%) | B (12%) | B (5%) |
| Example 118 | 118 | Toner-18 | Carrier 1 | B (12%) | B (0.3%) | B (12%) | C (3%) |
| Example 119 | 119 | Toner-19 | Carrier 1 | B (13%) | B (0.3%) | B (12%) | C (5%) |
| Example 120 | 120 | Toner-20 | Carrier 1 | B (17%) | B (0.3%) | A (9%) | A (3%) |
| Example 121 | 121 | Toner-21 | Carrier 1 | B (12%) | B (0.7%) | A (9%) | A (3%) |
| Example 122 | 122 | Toner-22 | Carrier 1 | B (17%) | B (0.3%) | B (13%) | A (3%) |
| Example 123 | 123 | Toner-23 | Carrier 1 | B (12%) | B (0.7%) | B (13%) | A (3%) |
| Example 124 | 124 | Toner-24 | Carrier 1 | B (12%) | B (0.9%) | B (18%) | C (7%) |
| Example 125 | 125 | Toner-25 | Carrier 1 | B (12%) | B (0.9%) | B (18%) | C (7%) |
| Example 126 | 126 | Toner-26 | Carrier 1 | B (12%) | B (0.9%) | C (22%) | C (7%) |
| Example 127 | 127 | Toner-27 | Carrier 1 | B (19%) | B (0.9%) | B (14%) | C (7%) |
| Example 128 | 128 | Toner-28 | Carrier 1 | B (19%) | B (0.9%) | B (14%) | C (7%) |
| Example 129 | 129 | Toner-29 | Carrier 1 | B (19%) | C (0.5%) | B (15%) | C (7%) |
| Example 130 | 130 | Toner-30 | Carrier 1 | C (23%) | B (0.4%) | B (15%) | C (7%) |
| Example 131 | 131 | Toner-31 | Carrier 1 | C (24%) | C (0.6%) | C (22%) | C (7%) |
| Comparative Example 101 | 132 | Toner-32 | Carrier 1 | C (27%) | D (1.6%) | C (28%) | D (13%) |
| Comparative Example 102 | 133 | Toner-33 | Carrier 1 | C (28%) | D (2.1%) | C (28%) | D (14%) |
| Comparative Example 103 | 134 | Toner-34 | Carrier 1 | D (33%) | C (0.9%) | D (38%) | D (14%) |
| Comparative Example 104 | 135 | Toner-35 | Carrier 1 | D (40%) | C (0.6%) | C (28%) | D (11%) |
| Comparative Example 105 | 136 | Toner-36 | Carrier 1 | D (32%) | C (0.6%) | D (32%) | D (14%) |
| Comparative Example 106 | 137 | Toner-37 | Carrier 1 | D (32%) | C (0.6%) | D (32%) | D (13%) |
| Comparative Example 107 | 138 | Toner-38 | Carrier 1 | D (32%) | C (0.6%) | C (28%) | D (14%) |
| Comparative Example 108 | 139 | Toner-39 | Carrier 1 | C (28%) | D (2.2%) | C (28%) | D (14%) |
| Comparative Example 109 | 140 | Toner-40 | Carrier 1 | D (55%) | C (0.9%) | C (28%) | C (7%) |
| Comparative Example 110 | 141 | Toner-41 | Carrier 1 | D (45%) | D (2.5%) | C (28%) | C (7%) |
| Comparative Example 111 | 142 | Toner-42 | Carrier 1 | D (35%) | C (0.9%) | C (28%) | D (14%) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-264246, filed Dec. 20, 2013 which is hereby incorporated by reference herein in its entirety.

What is claimed is:

1. A toner comprising toner particles made of a resin containing:

an amorphous polyester resin;

a releasing agent;

an additive and a coloring agent, wherein:

the additive comprises a resin having a polyester portion and a crystalline acrylic portion that are chemically bound to each other, the crystalline acrylic portion has a partial structure expressed by the following chemical formula:

(1)

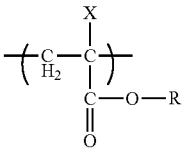

R represents a hydrocarbon group having a carbon number of 18 to 30, and X represents hydrogen or a methyl group, and 95% by mole or more of all structural units of the crystalline acrylic portion are structural units derived from only one of acrylic and methacrylic esters.

2. The toner according to claim 1, wherein the toner particles are prepared through a melt-kneading step.

3. The toner according to claim 1, wherein the additive has a melting peak on a temperature-endothermic curve thereof prepared by differential scanning calorimetry, the melting peak:

i) lying at a peak temperature Tmc in the range of 50° C. to 70° C.;

ii) representing a heat of melting in the range of 2.00 J/g to 20.00 J/g for 1 g of the additive; and iii) having a half-width of 5.00° C. or less.

4. The toner according to claim 3, wherein the releasing agent has a melting peak on a temperature-endothermic curve thereof prepared by differential scanning calorimetry, and the melting peak thereof satisfies the relationship:

$3 \leq Tmb - Tmc \leq 23$, where Tmb represents the melting peak temperature in degrees Celsius of the releasing agent and Tmc represents the melting peak temperature in degrees Celsius of the additive.

5. The toner according to claim 1, wherein the toner particles contain a crystalline polyester resin.

6. A two-component developer comprising:

the toner as set forth in claim 1; and a magnetic carrier.

* * * * *